US008833889B2

(12) United States Patent
Kanno et al.

(10) Patent No.: US 8,833,889 B2
(45) Date of Patent: Sep. 16, 2014

(54) ELEMENT SUBSTRATE, PRINTHEAD AND PRINTING APPARATUS

(71) Applicant: Canon Kabushiki Kaisha, Tokyo (JP)

(72) Inventors: Hideo Kanno, Yokohama (JP); Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/644,811

(22) Filed: Oct. 4, 2012

(65) Prior Publication Data

US 2013/0093808 A1 Apr. 18, 2013

(30) Foreign Application Priority Data

Oct. 14, 2011 (JP) ..... 2011-227435

(51) Int. Cl.
*B41J 29/38* (2006.01)
*B41J 2/05* (2006.01)
*B41J 2/045* (2006.01)

(52) U.S. Cl.
CPC ..... *B41J 2/04563* (2013.01); *B41J 2/04508* (2013.01); *B41J 2/04541* (2013.01); *B41J 2/0451* (2013.01); *B41J 2/0455* (2013.01); *B41J 2/0458* (2013.01)
USPC ..... 347/9; 347/10.57

(58) Field of Classification Search
USPC ..... 347/9–12, 50, 54, 19, 44, 14, 56–59
See application file for complete search history.

(56) References Cited

U.S. PATENT DOCUMENTS 6,293,655 B1 * 9/2001 Imanaka et al. ..... 347/65
6,634,731 B2 * 10/2003 Kao et al. ..... 347/14
7,344,218 B2 3/2008 Imanaka et al.
7,364,272 B2 * 4/2008 Furukawa et al. ..... 347/61
7,448,730 B2 11/2008 Hirayama
7,690,751 B2 4/2010 Takabayashi et al.
7,722,148 B2 5/2010 Takabayashi et al.
7,802,866 B2 9/2010 Kanno et al.
8,033,631 B2 * 10/2011 Kanno ..... 347/17
8,070,262 B2 12/2011 Yamaguchi et al.

(Continued)

FOREIGN PATENT DOCUMENTS

CN 101092074 A 12/2007
CN 101092075 A 12/2007

(Continued)

OTHER PUBLICATIONS

European Search Report dated Jan. 16, 2013, European Application No. 12006783.

Office Action issued in Chinese Application No. 201210390446.0 dated May 4, 2014.

*Primary Examiner* — Anh T. N. Vo

(74) *Attorney, Agent, or Firm* — Fitzpatrick, Cella, Harper & Scinto

(57) ABSTRACT

An element substrate, comprising a first resistance element and second resistance element each of which includes a first terminal and a second terminal and is arranged in a predetermined direction, wherein the first terminals are connected to a first line for commonly supplying a current, and the second terminals are connected to a second line for commonly supplying a current, and a detection unit configured to detect a voltage of the first terminal of the first resistance element and a voltage of the first terminal of the second resistance element while power is supplied to the first resistance element and is not supplied to the second resistance element.

9 Claims, 16 Drawing Sheets

(56) References Cited

U.S. PATENT DOCUMENTS

| | | | |
|---|---|---|---|
| 8,287,082 | B2 | 10/2012 | Aoki et al. |
| 2010/0201754 | A1 | 8/2010 | Tsuchii et al. |
| 2010/0315454 | A1 | 12/2010 | Kanno |
| 2011/0273507 | A1 | 11/2011 | Yamato et al. |

FOREIGN PATENT DOCUMENTS

| | | | |
|---|---|---|---|
| CN | 101574865 | A | 11/2009 |
| JP | 2007290361 | A | 11/2007 |
| JP | 2008-23987 | A | 2/2008 |
| JP | 2010-201921 | A | 9/2010 |

* cited by examiner

ELEMENT SUBSTRATE, PRINTHEAD AND PRINTING APPARATUS

BACKGROUND OF THE INVENTION

1. Field of the Invention

The present invention relates to an element substrate, printhead, and printing apparatus.

2. Description of the Related Art

There is known an element substrate (driving head) including a plurality of driving elements for generating thermal, mechanical, magnetic, or light (electromagnetic wave) energy. The element substrate sometimes needs to directly or indirectly inspect a phenomenon generated upon driving and feed it back to the driving control.

For example, a case in which such an element substrate is applied to an inkjet printhead (to be referred to as a printhead hereinafter) will be examined. In the printhead, all or some nozzles may generate a discharge failure owing to clogging of nozzles with a foreign substance, bubbles entering an ink supply path, a change of wettability of the nozzle surface, or the like. In this case, nozzles suffering a discharge failure as a phenomenon generated upon driving need to be specified and reflected in image supplement and printhead recovery work.

To implement this technique, Japanese Patent Laid-Open No. 2008-023987 discloses a method in which a temperature detection element formed from a thin-film resistor is arranged on an insulating film in each printing element for performing electrothermal conversion. The temperature detection element detects temperature data of each nozzle to inspect a nozzle suffering a discharge failure based on a temperature change.

When detection elements and an accessory circuit are arranged near respective driving elements, it is necessary not to affect the structure including the driving elements, the function, and the performance. In addition, the arrangement location is restricted.

For example, when a temperature detection circuit is arranged in the printhead disclosed in Japanese Patent Laid-Open No. 2008-023987, it is necessary not to change the printing element, its wiring, the ink supply path, and the nozzle structure.

SUMMARY OF THE INVENTION

The present invention has been made to overcome the conventional problems, and provides a technique advantageous for providing a technique capable of suppressing the influence on the structure including a driving element, the function, and the performance when arranging a detection element.

One of the aspects of the present invention provides an element substrate comprising, a first resistance element and a second resistance element each of which includes a first terminal and a second terminal and is arranged in a predetermined direction, wherein the first terminals of the first resistance element and the second resistance element are selectively connected to a first line for supplying a current, and the second terminals of the first resistance element and second resistance element are commonly connected to a second line for supplying a current, and a detection unit configured to detect a voltage of the first terminal of the first resistance element and a voltage of the first terminal of the second resistance element while power is supplied to the first resistance element and is not supplied to the second resistance element.

Further features of the present invention will become apparent from the following description of exemplary embodiments with reference to the attached drawings.

DESCRIPTION OF THE EMBODIMENTS

Preferred embodiments of the present invention will now be described in detail with reference to the accompanying drawings. In the following description, "print" not only includes the formation of significant information such as characters and graphics, but also broadly includes the formation of images, designs, patterns, structures, and the like on a printing medium, or processing of the medium, regardless of whether they are significant or insignificant and whether they are so visualized as to be visually perceived by humans.

Also, a "printing medium" not only includes paper used in general printing apparatuses, but also includes materials capable of accepting ink, such as cloth, plastic film, metal plate, glass, ceramics, resin, wood, and leather.

Also, "ink" should be broadly interpreted similar to the definition of "print" described above. "Ink" includes a liquid which, when applied onto a printing medium, can form images, designs, patterns, and the like, can process the printing medium, or can be used for ink processing (for example, solidification or insolubilization of a coloring material contained in ink applied to a printing medium).

Further, a "printing element" (to be also referred to as a "nozzle") generically means an ink discharge orifice or a liquid channel communicating with it, and an element for generating energy used to discharge ink, unless otherwise specified.

Figure 1:
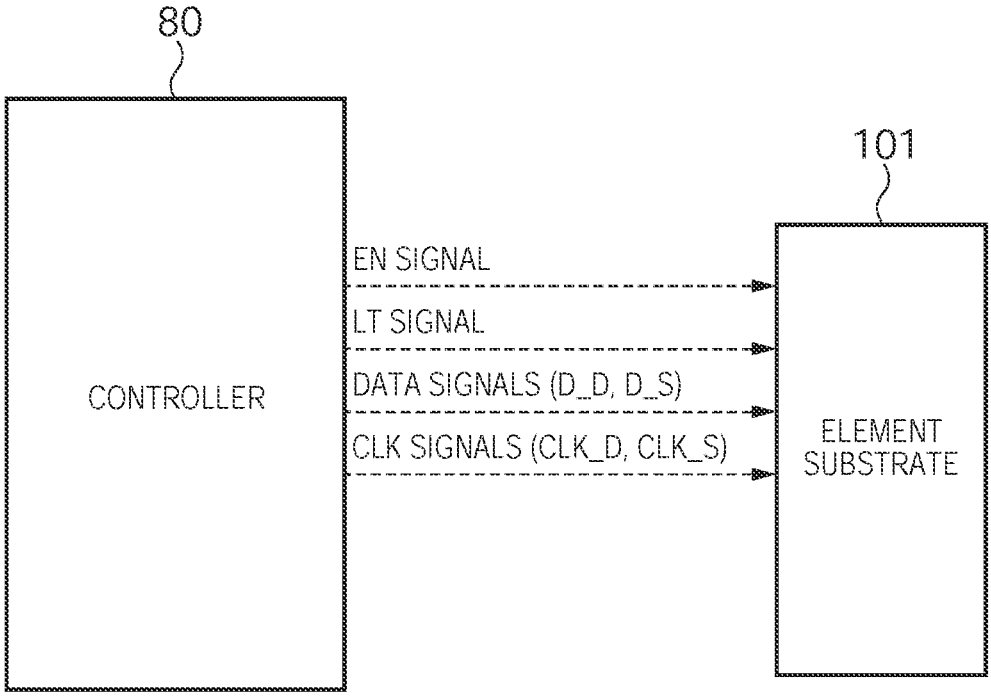
FIG. 1 is a block diagram exemplifying an apparatus configured by arranging an element substrate 101.

FIG. 1 is a block diagram exemplifying an apparatus configured by arranging an element substrate 101 according to an embodiment of the present invention.

A controller 80 transmits various signals to the element substrate (detection circuit) 101 to executively control the operation of the element substrate 101. Examples of the signals transmitted from the controller 80 to the element substrate 101 are an enable signal EN, a latch signal LT, serial data signals D_D and D_S, and clock signals CLK_D and CLK_S.

Figure 2:
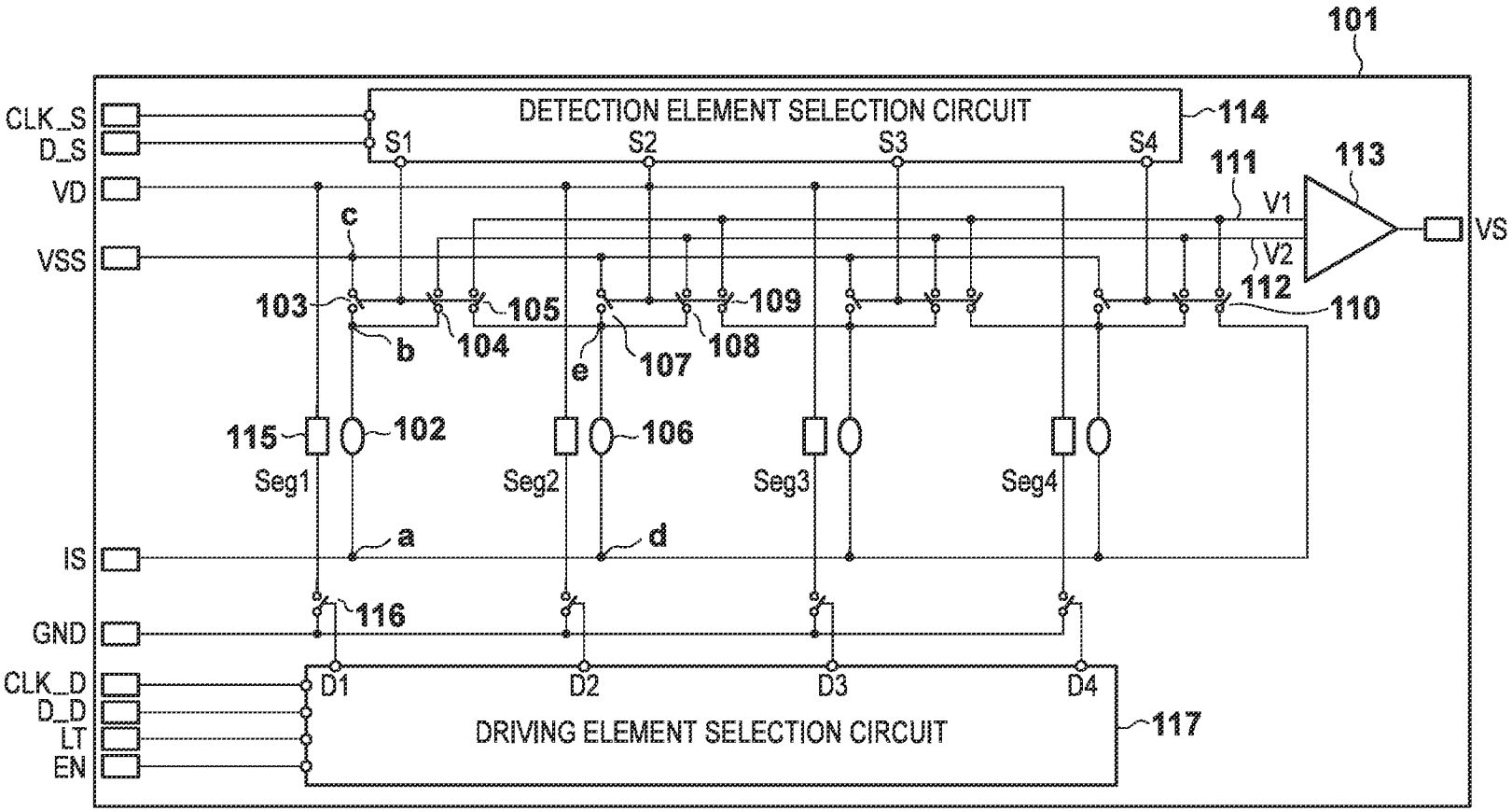
FIG. 2 is a connection diagram showing the element substrate 101 shown in FIG. 1.

An example of the arrangement of the element substrate 101 shown in FIG. 1 will be explained with reference to FIG. 2. An arrangement in which driving elements and detection elements for four segments are arranged will be exemplified. Note that the detection element is applied to a temperature detection circuit using a temperature measurement resistor, a temperature detection circuit using a thermistor, a temperature detection circuit using a thermocouple, a light detection circuit using CdS (photoelectric effect), and the like, as in Japanese Patent Laid-Open No. 2008-023987. The detection element is not limited to these examples as long as it is a two-terminal element and transmits a DC voltage (that is, does not generate a voltage drop) even upon receiving a current from a constant current source when the detection element is not selected.

The element substrate 101 includes a plurality of detection elements. These detection elements are arranged near respective driving elements in correspondence with them. One terminal of a driving element 115 of Seg1 is (parallelly) commonly connected to a VD wiring line for supplying a driving voltage to the driving element 115, and the other terminal is connected to a driving switch 116. The other terminal of the driving switch 116 is connected to a GND wiring line serving as the return (recovery) destination of VD.

The driving switch 116 is connected to a driving element selection circuit 117, and ON/OFF-controlled in accordance with a selection signal (signal for designating selection of a detection element) D1 from the circuit 117. The driving elements 115 of Seg2 to Seg4 also have the same arrangement as that of Seg1.

One terminal (first terminal) of a detection element 102 of Seg1 is commonly connected to the wiring line (constant current common wiring line) of a constant current IS supplied from a constant current source. The other terminal (second terminal: terminal arranged on a side opposite to the first terminal via a resistor) is connected to a selection switch 103 and second readout switch 104. The selection switch 103 selects the detection element 102, supplies a current from the constant current source to the (resistor of) selected detection element 102, and causes the detection element 102 to perform a detection operation. The second readout switch 104 reads out a terminal voltage, and inputs it to a second common wiring line 112. The other terminal of the second readout switch 104 is connected to the second common wiring line 112. The other terminal of the selection switch 103 is connected to a VSS wiring line serving as the return destination of the constant current IS. By turning on/off the selection switch 103, the constant current IS is supplied to the (resistor of) detection element. Note that the constant current source is arranged in, for example, a printhead controller 25.

Of terminals of the detection element 102, a terminal connected to the wiring line of the constant current IS is connected to a first readout switch 105 via the wiring line of the constant current IS and a detection element 106 of Seg2. The other terminal of the first readout switch 105 is connected to a first common wiring line 111. The first readout switch 105 reads out a terminal voltage, and inputs it to the first common wiring line 111.

The detection elements of Seg2 to Seg4 are also connected similarly to Seg1. Of terminals of each detection element, a terminal commonly connected to the wiring line of the constant current IS is connected to the first readout switch 105 via an adjacent detection element. Note that Seg4 is arranged at the end of the circuit, and the wiring line of the constant current IS is directly connected to a first readout switch 110. The selection switches and readout switches of Seg1 to Seg4 are ON/OFF-controlled in accordance with selection signals S1 to S4 from a detection element selection circuit 114.

A differential amplifier 113 receives V1 and V2 signals serving as terminal voltages of a selected detection element via the common wiring lines 111 and 112. Upon receiving the V1 and V2 signals (two terminal voltages), the differential amplifier 113 generates a differential signal VS corresponding to the voltage difference. The differential signal VS serves as detection information representing a voltage across the detection element. Note that the differential amplifier 113 has a sufficiently high input resistance to prevent a current supplied to the detection element from flowing into the paths between the readout switches and the common wiring lines 111 and 112. That is, the inputs of the differential amplifier 113 for the V1 and V2 signals are set to a high impedance.

The driving element selection circuit 117 includes a 4-bit shift register and 2-line decoder, and performs 2×2 time-divisional drive. The driving element selection circuit 117 receives row data for turning on/off a driving element and column data for designating a block, and generates selection signals D1 to D4. The detection element selection circuit 114 includes a 4-bit shift register. The detection element selection circuit 114 receives a shift clock and start pulse, and generates the selection signals S1 to S4.

An operation in the element substrate 101 will be explained. A case in which the detection element 102 of Seg1 is selected will be exemplified.

First, the selection switch 103 and the readout switches 104 and 105 are turned on in accordance with the selection signal S1 from the detection element selection circuit 114. Upon turning on the selection switch 103, the constant current IS is supplied to the detection element 102 of Seg1. At this time, a selection switch 107 is OFF. The constant current IS is not supplied to the detection element 106 of Seg2. Hence, the detection element 102 of Seg1 is selected, and generates a terminal voltage corresponding to a detection amount.

Then, the terminal voltage V2 signal of the detection element 102 on the side of the selection switch 103 is input to the differential amplifier 113 via the second readout switch 104. The terminal voltage V1 signal (strictly, the terminal voltage of the detection element 106 of Seg2 on the wiring line side of the constant current IS) of the detection element 102 on the wiring line side of the constant current IS is input to the differential amplifier 113 via the detection element 106 of Seg2 and the first readout switch 105. Since the selection switch 103 is turned on, the constant current IS flows from the IS terminal→a→b→c→VSS terminal. In contrast, the selection switch 107 is turned off, so no current flows through an a-d path or d-e path. A voltage at position a is therefore equal to a voltage at position d and a voltage at position e. Thus, inputting a voltage at position e as the V1 signal to the differential amplifier 113 via the readout switch 105 is equivalent to inputting a voltage at position a as the V1 signal to the differential amplifier 113. A voltage at position b is input as the V2 signal to the differential amplifier 113 via the readout switch 104.

Upon receiving the V1 and V2 signals, the differential amplifier 113 outputs the differential signal VS serving as a voltage across the detection element 102. Also, in Seg2 to Seg4, detection elements are sequentially selected by the same operation, reading out temperature data of the respective segments.

Figure 3A:
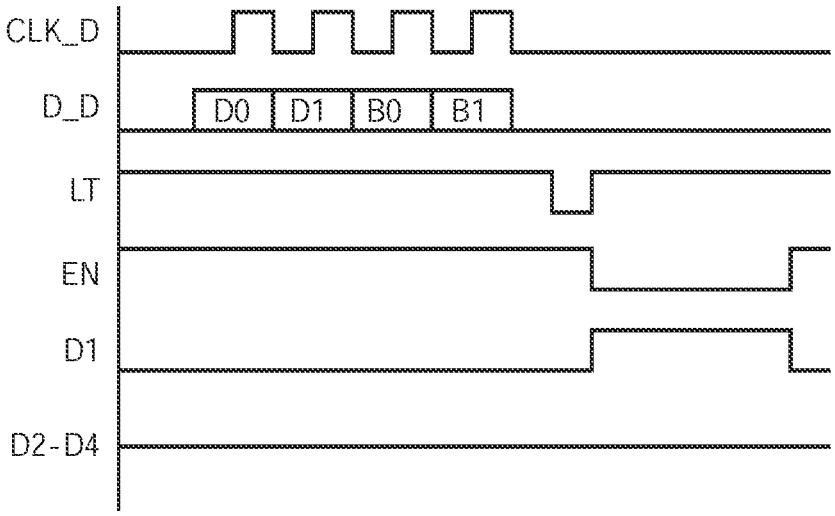
FIGS. 3A and 3B are timing charts exemplifying the timings of various signals.

Various signals to be supplied from the controller 80 to the driving element selection circuit 117 and various signals to be output from the driving element selection circuit 117 will be explained with reference to FIG. 3A. A case in which the selection signal D1 corresponding to the driving element 115 of Seg1 is selected will be exemplified.

The controller 80 sets row data D0 and D1 of 2 bits, and block data B0 and B1 to be contained in the serial data signal D_D, and transfers them to the element substrate 101 in synchronism with the transfer clock signal CLK_D. The element substrate 101 latches and holds the serial data signal at the timing when the controller 80 transfers the latch signal LT. Immediately after this latching, the controller 80 transfers the enable signal EN to the element substrate 101. Accordingly, an application pulse is supplied to the driving element 115.

Figure 3B:
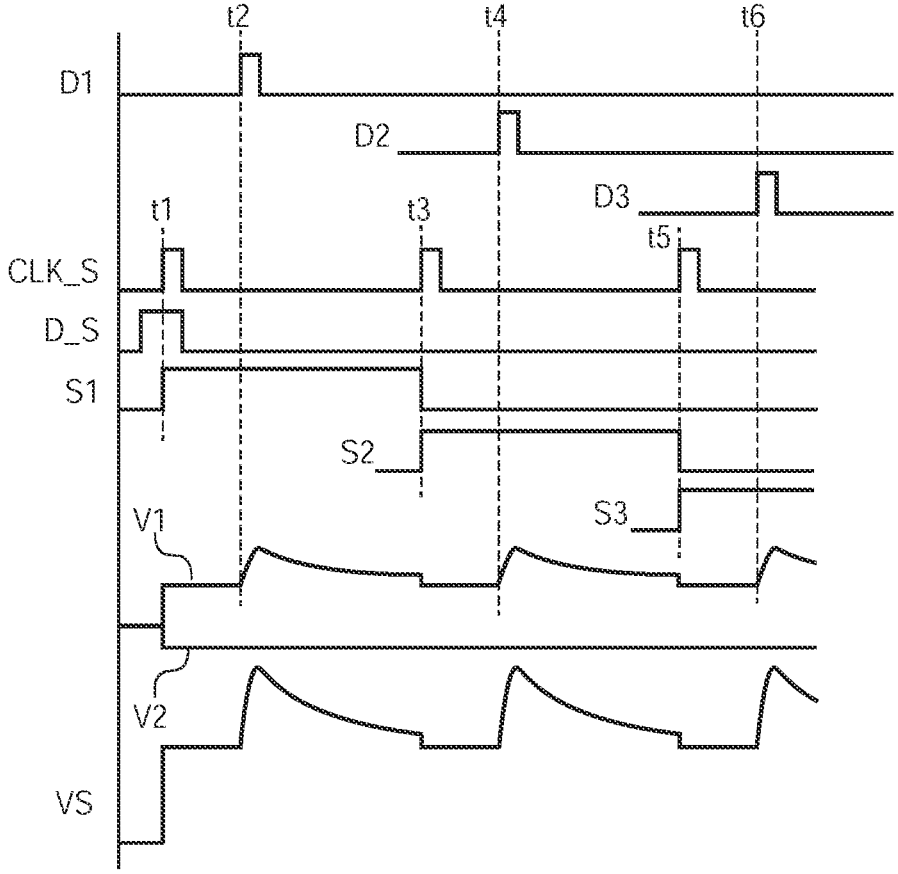

Next, timings to sequentially select driving elements one by one at data transfer timings and select detection elements in synchronism with them will be explained with reference to FIG. 3B.

At timing t1, the controller 80 supplies a shift clock to the shift clock signal CLK_S and a start pulse to the serial data signal D_S, thereby enabling the selection signal S1 output from the detection element selection circuit 114. As a result, the detection element 102 of Seg1 is selected.

At timing t2, the driving element selection circuit 117 enables the selection signal D1 to drive the driving element 115 of Seg1. The detection element 102 outputs the terminal voltage V1 signal and V2 signal in a selection period between driving ON and OFF. Then, the differential amplifier 113 outputs the differential signal VS.

At timing t3, the detection element 106 of Seg2 is selected similarly. At timing t4, the driving element of Seg2 is driven, thereby outputting detection information of Seg2. In the same manner, Seg3 and Seg4 are selected sequentially, reading out detection information of all the segments.

Note that the waveforms of the V1 and V2 signals exemplify waveforms when the driving element operates as a heating element and the detection element operates as a temperature detection element. These waveforms are merely examples, and change depending on the driving element and detection element.

As described above, according to the first embodiment, a terminal of the detection element that is commonly connected to the wiring line of the constant current IS is connected to the first common wiring line 111 using the wiring line of an adjacent detection element. This omits one of readout wiring lines for two terminals of the detection element.

Since the detection element itself is used as a wiring line, the arrangement of the element substrate (detection circuit) is simplified. Further, the detection element can be arranged on the substrate without or by reducing the influence on the structure including the driving elements, the function, and the performance.

Second Embodiment

The second embodiment will be described. The second embodiment will explain a case in which the above-described element substrate is applied as a printing element substrate in an inkjet printhead (to be simply referred to as a printhead hereinafter) proposed in Japanese Patent Laid-Open No. 2008-023987.

Figure 4:
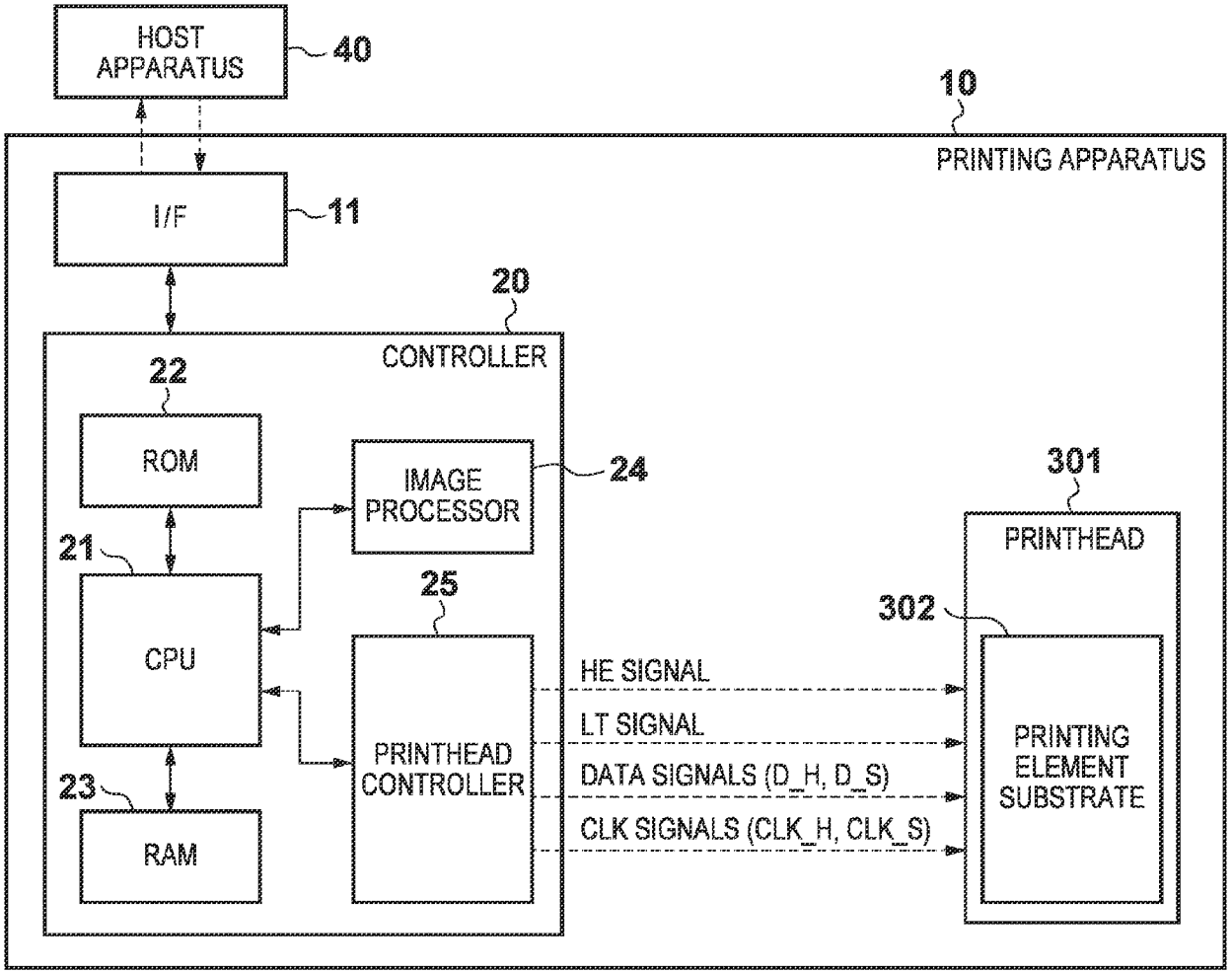
FIG. 4 is a block diagram exemplifying the arrangement of the control system of a printing apparatus 10.

An example of the arrangement of the control system of a printing apparatus 10 will be explained with reference to FIG. 4.

The printing apparatus 10 is connected to a host apparatus 40. The host apparatus 40 is implemented by a computer (or an image reader or digital camera) serving as an image data supply source. The host apparatus 40 and printing apparatus 10 exchange image data, commands, and the like via an interface (to be referred to as I/F hereinafter) 11.

In the printing apparatus 10, an inkjet printhead (to be referred to as a printhead hereinafter) 301 which prints by discharging ink according to the inkjet method is mounted on a carriage (not shown). While the carriage reciprocates in predetermined directions, the printhead 301 prints. More specifically, while moving relatively to a printing medium, the printhead prints an image on the printing medium.

A controller 20 includes a CPU (Central Processing Unit) 21, ROM (Read Only Memory) 22, RAM (Random Access Memory) 23, image processor 24, and printhead controller 25.

The CPU 21 executively controls processes in the controller 20. The ROM 22 stores programs and various data. The RAM 23 is used as a work area when executing a program by the CPU 21, and temporarily stores various calculation results and the like.

The image processor 24 performs various image processes for image data received from the host apparatus 40 via the I/F 11.

The printhead controller 25 controls the printhead 301. The printhead controller 25 generates various signals, and transfers the generated signals to the printhead 301. By using these signals, the printhead controller 25 controls time-divisional drive by the printhead 301. Examples of the signals transferred to the printhead 301 are a heat enable signal HE, a latch signal LT, serial data signals D_H and D_S, and clock signals CLK_H and CLK_S.

Based on the signals transferred from the printhead controller 25, the printhead 301 discharges ink from discharge orifices in the printhead 301. The printhead 301 includes a printing element substrate (to be also simply referred to as a substrate hereinafter) 302. A plurality of nozzle arrays are arranged on the substrate. The printhead 301 complies with, for example, an inkjet method of discharging ink using thermal energy. The printhead 301 includes printing elements each formed from a heater or the like, and a control circuit which controls driving of the heaters. The heaters are arranged in correspondence with respective nozzles (discharge orifices), and a pulse voltage is applied to a corresponding heater in accordance with a printing signal.

Figure 5A:
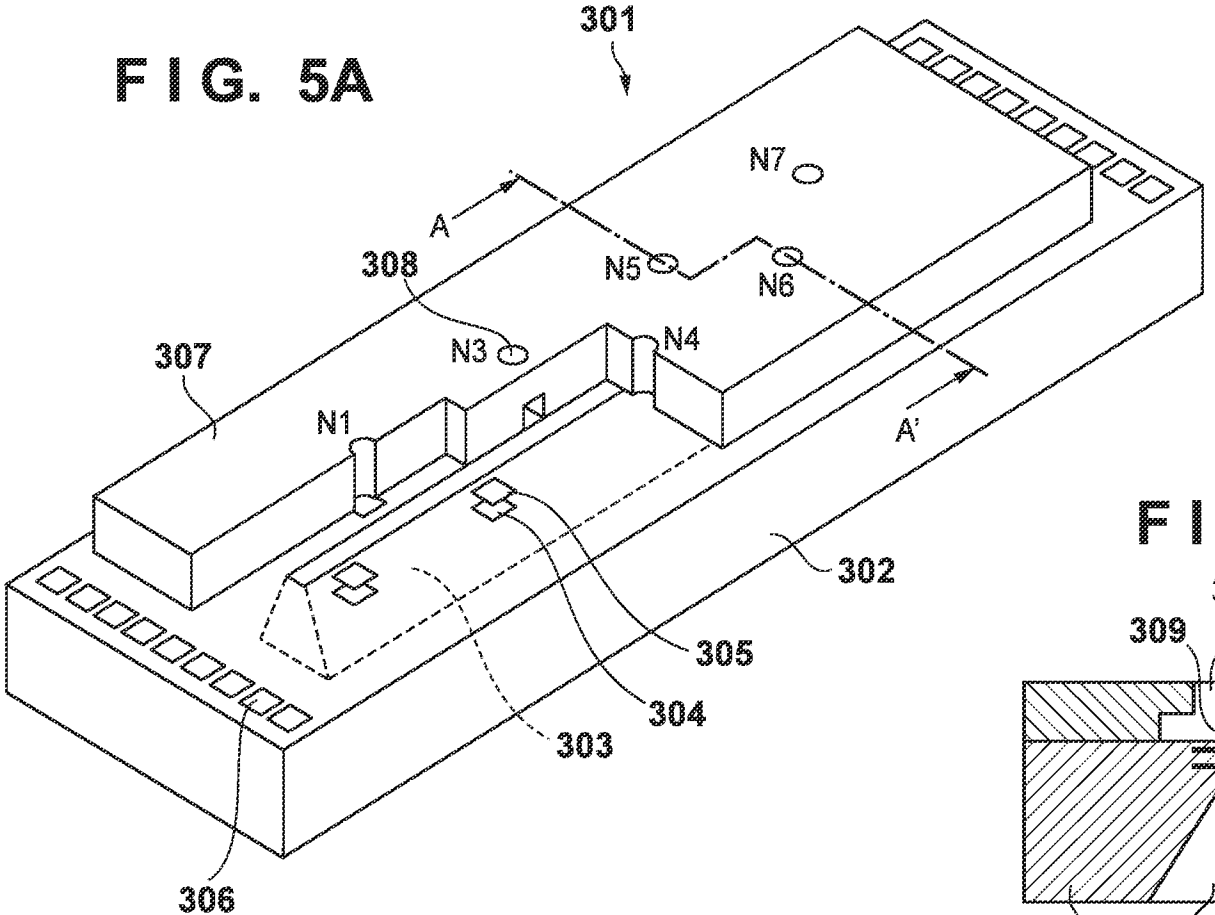
FIGS. 5A and 5B are views exemplifying the arrangement of a printhead according to the second embodiment.
Figure 5B:
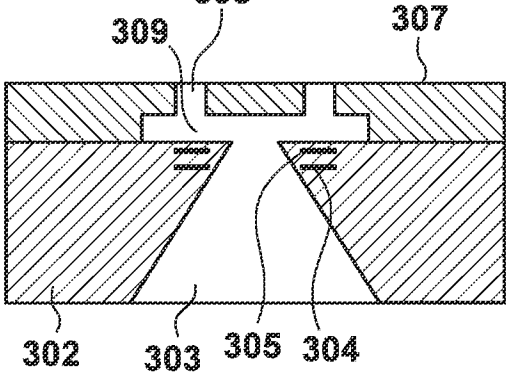

An example of the arrangement of the printhead according to the second embodiment will be explained with reference to FIGS. 5A and 5B. FIG. 5A is a perspective view showing the printhead according to the second embodiment. FIG. 5B is a sectional view exemplifying a sectional arrangement taken along a line A-A' shown in FIG. 5A.

An ink supply port 303 is formed to extend through the printing element substrate 302 from the lower surface to upper surface of the printhead 301, and supply ink. The printing element substrate 302 includes printing elements 305 serving as driving elements for performing electrothermal conversion (generating thermal energy), and temperature detection elements 304 formed from thin-film resistors as detection elements.

Nozzles 308 are formed in an orifice plate 307 in correspondence with the printing elements 305. Nozzles N0 to N7 are arranged alternately in two arrays in the nozzle array direction on the two sides of the ink supply port 303. Electrode terminals 306 are arranged to connect external wiring lines.

As shown in FIG. 5B, the printing element 305 and temperature detection element 304 are paired, and the pairs of printing element 305 and temperature detection element 304 are arranged on the two sides of the ink supply port 303. A pressure chamber 309 communicating with the ink supply port 303, and the nozzles 308 are formed in the orifice plate 307 in correspondence with the printing elements.

Figure 6:
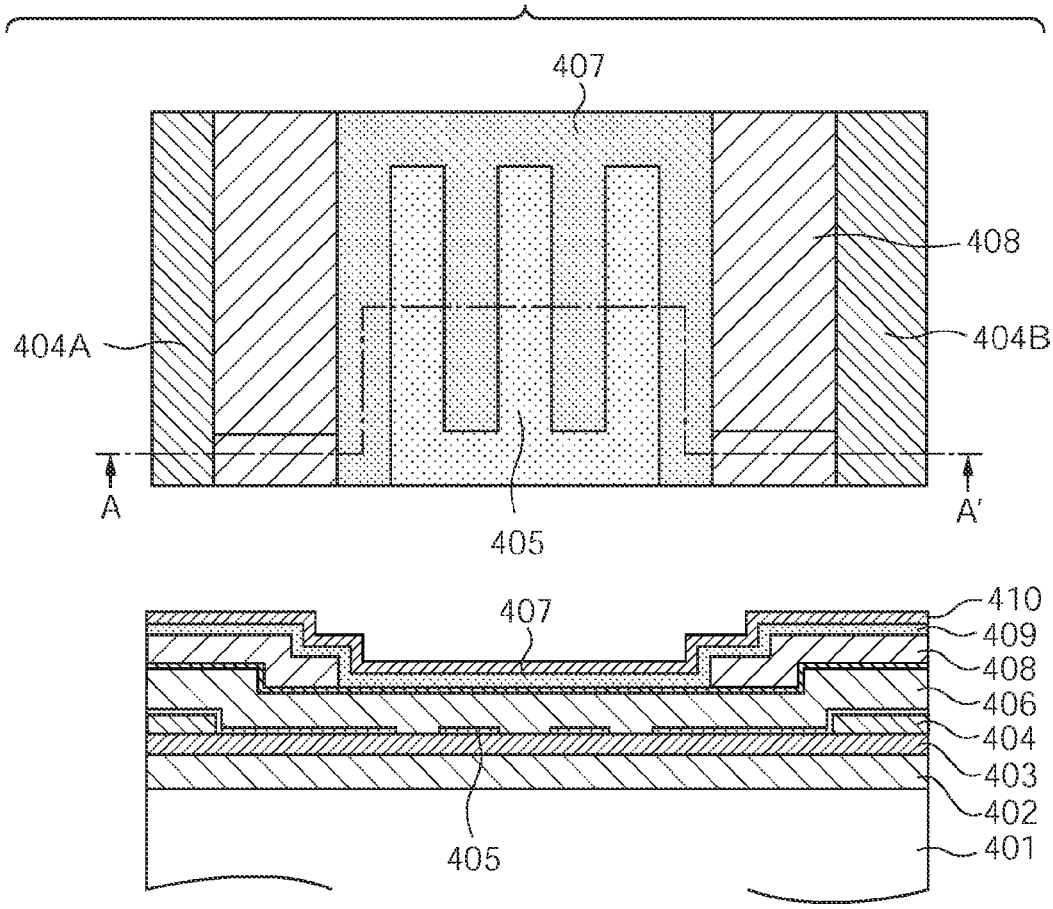
FIG. 6 is a view exemplifying the arrangement of the printhead according to the second embodiment.

FIG. 6 is a view exemplifying the planar and sectional arrangements of the printing element substrate 302. FIG. 6 does not illustrate nozzles.

A field oxide film 402 of $SiO_2$ or the like and an insulating film 403 are stacked on a silicon substrate 401. A temperature detection element 405 serving as a thin-film resistor of Al, Pt, Ti, Ta, or the like, and an AL1 interconnection 404 of aluminum or the like are formed on the insulating film 403. An interlayer dielectric film 406 of SiO or the like is stacked on the temperature detection element 405 and AL1 interconnection 404. A printing element 407 of TaSiN or the like for electrothermal conversion, and an AL2 interconnection 408 of aluminum or the like for connecting a driving circuit formed on the silicon substrate are formed on the interlayer dielectric film 406. Further, a protective film 409 of SiN or the like, and an anti-cavitation film 410 of Ta or the like for enhancing cavitation resistance on the printing element are stacked on the printing element 407 and AL2 interconnection 408.

The plan view at an upper portion in FIG. 6 shows the printing element 407, the AL2 interconnection 408 for connecting a driving circuit, the temperature detection element 405 surrounded by a chain line, an AL1 interconnection 404A serving as the individual wiring line of the temperature detection element 405, and an AL1 interconnection 404B serving as a common wiring line. The temperature detection element 405 has a serpentine shape to detect temperature data at high precision by increasing the resistance value and detection signal. The temperature detection element 405 is fabricated by performing deposition and patterning in the AL1 interconnection layer without changing the structure of a conventional printing element substrate.

Figure 7:
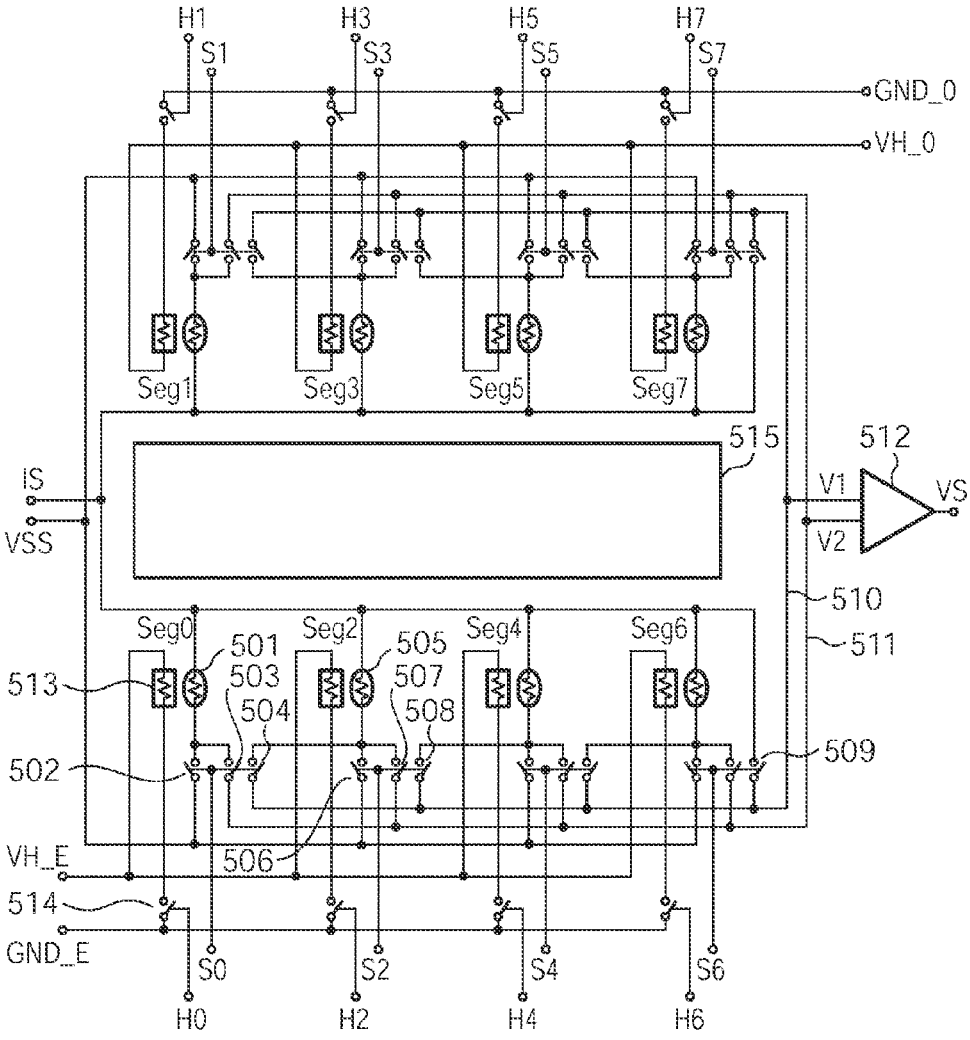
FIG. 7 is a connection diagram showing a printing element substrate according to the second embodiment.

FIG. 7 is a circuit diagram exemplifying the arrangement of the printing element substrate 302. The arrangement of the printing element substrate 302 will be explained by exemplifying an arrangement in which printing elements and temperature detection elements of two arrays for four segments are arranged. Note that an ink supply port 515 is also illustrated to clarify the arrangement relationship between the circuit and the ink supply port.

One terminal of a printing element 513 of Seg0 is connected to a VH_E wiring line for supplying a driving voltage to the printing element 513, and the other terminal is connected to a driving switch 514. The other terminal of the driving switch 514 is connected to a GND_E wiring line serving as the return destination of VH_E. The driving switch 514 is ON/OFF-controlled in accordance with a selection signal H0 from a printing element selection circuit (not shown). Seg2, Seg4, and Seg6 also have the same connection as that of Seg0. Seg1, Seg3, Seg5, and Seg7 arranged at positions opposite to Seg0, Seg2, Seg4, and Seg6 via the ink supply port 515 also have the same connection.

One terminal of a temperature detection element 501 of Seg0 is commonly connected to the wiring line of the constant current IS for feeding power to the temperature detection element 501. The other terminal is connected to a selection switch 502, and a second readout switch 503 for reading out a terminal voltage. The other terminal of the second readout switch 503 is connected to a second common wiring line 511.

The other terminal of the selection switch 502 is connected to a VSS wiring line serving as the return destination of the constant current IS. Of terminals of the temperature detection element 501, a terminal connected to the wiring line of the constant current IS is connected to a first readout switch 504 via the wiring line of the constant current IS and a temperature detection element 505 of Seg2. The other terminal of the first readout switch 504 is connected to a first common wiring line 510. The temperature detection elements of Seg2, Seg4, and Seg6 are also connected similarly to that of Seg0.

In this fashion, of terminals of the temperature detection element, a terminal commonly connected to the wiring line of the constant current IS is connected to the first readout switch via an adjacent temperature detection element. Note that Seg6 is arranged at the end of the circuit, and the wiring line of the constant current IS is directly connected to a readout switch 509. Thus, one terminal of the temperature detection element of Seg6 is connected to the common wiring line 510.

The common wiring lines 510 and 511 are connected to a differential amplifier 512. The selection switches and readout switches of Seg0 to Seg6 are ON/OFF-controlled in accordance with selection signals S0 to S6 from a temperature detection element selection circuit (not shown). Seg1, Seg3, Seg5, and Seg7 which face Seg0, Seg2, Seg4, and Seg6 via the ink supply port 515 also have the same connection.

On the printing element substrate 302, the printing element selection circuit and temperature detection element selection circuit are also arranged. These circuits have the same arrangements and operations as those of the driving element selection circuit 117 and detection element selection circuit 114 described in the first embodiment, and an illustration and detailed description thereof will not be repeated.

An operation in the printing element substrate 302 will be explained. Seg0 will be exemplified here.

First, the temperature detection element selection circuit (not shown) enables the selection signal S0 to turn on the selection switch 502 and the readout switches 503 and 504, thereby selecting the temperature detection element 501 of Seg0.

Upon turning on the selection switch 502, the constant current IS is supplied to the temperature detection element 501, and the temperature detection element 501 outputs a terminal voltage corresponding to a temperature. The terminal voltage V2 signal of the temperature detection element 501 on the side of the selection switch 502 is input to the differential amplifier 512 via the second readout switch 503. The terminal voltage V1 signal of the temperature detection element 501 on the wiring line side of the constant current IS is input to the differential amplifier 512 via the temperature detection element 505 of Seg2 and the first readout switch 504.

Upon receiving the V1 and V2 signals, the differential amplifier 512 outputs a differential signal VS serving as a voltage across the temperature detection element 501. In the same manner, Seg2, Seg4, and Seg6 are also sequentially selected, reading out detection information (temperature data) of the respective segments. Temperature data are also read out from Seg1, Seg3, Seg5, and Seg7 by the same operation. Note that time-divisional drive of a plurality of driving elements is performed respectively in a group of Seg0, Seg2, Seg4, and Seg6 and a group of Seg1, Seg3, Seg5, and Seg7.

As described above, according to the second embodiment, a terminal of the temperature detection element 501 that is commonly connected to the wiring line of the constant current IS is connected to the first common wiring line 510 using an adjacent temperature detection element. This omits one of readout wiring lines for two terminals of the temperature detection element.

Since the temperature detection element itself is used as a wiring line, the arrangement of the printing element substrate is simplified. The temperature detection element can be arranged without or by reducing the influence on the structure including the printing elements, the function, and the performance.

Third Embodiment

The third embodiment will be described. The third embodiment will explain a case in which the above-described temperature detection circuit is applied as a printing element substrate to a printhead having a channel structure proposed in Japanese Patent Laid-Open No. 2010-201921.

In Japanese Patent Laid-Open No. 2010-201921, ink channels are arranged symmetrically about discharge orifices. Japanese Patent Laid-Open No. 2010-201921 discloses an arrangement in which the discharge frequency is increased in an ink channel sandwiched by a plurality of independent supply ports, and the pressure crosstalk between discharge orifices is reduced to stably discharge ink. Note that the arrangement of the control system of a printing apparatus 10 is the same as that in FIG. 4 described in the second embodiment, and a description thereof will not be repeated.

Figures 8A, 8B, 8C:
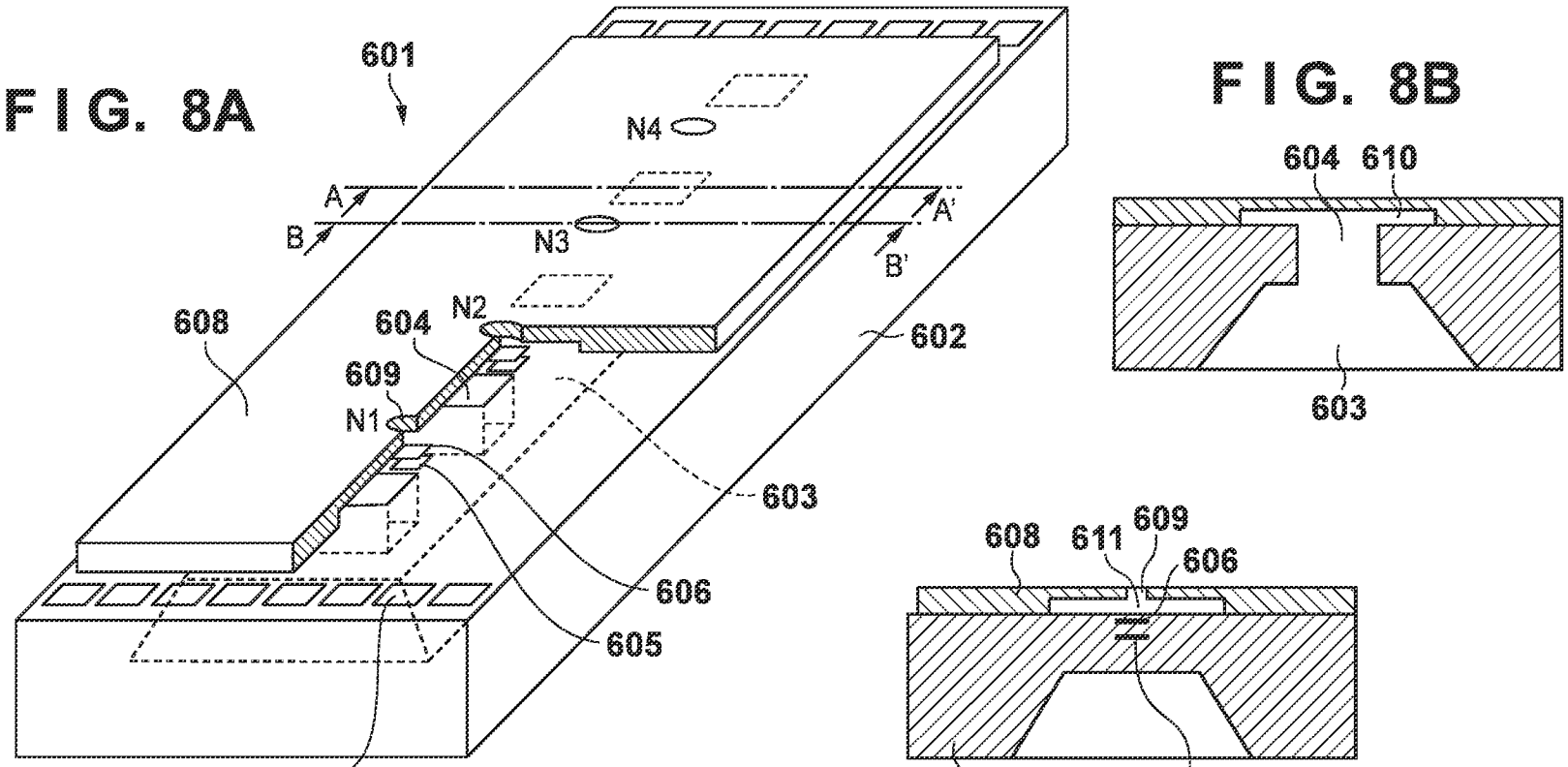
FIGS. 8A to 8C are views exemplifying the arrangement of a printhead according to the third embodiment.

An example of the arrangement of the printhead according to the third embodiment will be explained with reference to FIGS. 8A to 8C. FIG. 8A is a perspective view showing the printhead according to the third embodiment. FIG. 8B is a sectional view exemplifying a sectional arrangement taken along a line A-A' shown in FIG. 8A. FIG. 8C is a sectional view exemplifying a sectional arrangement taken along a line B-B' shown in FIG. 8A.

A common supply port 603 is formed in a printhead 601, and a plurality of independent supply ports 604 receive supply of ink via the common supply port 603. The independent supply ports 604 are formed at the upper portion of a printing element substrate 602. Printing elements 606 serving as driving elements for performing electrothermal conversion, and temperature detection elements 605 formed from thin-film resistors as detection elements are arranged. Electrode terminals 607 are arranged to connect external wiring lines.

As shown in FIG. 8C, the printing element 606 and temperature detection element 605 are paired and arranged on a beam between the independent supply ports. Pressure chambers 611 communicating with the independent supply ports 604, and nozzles 609 are formed in an orifice plate 608 in correspondence with the printing elements.

An ink supply path in which the common supply port 603 formed in the printing element substrate 602, the independent supply ports 604, and liquid chambers 610 of the orifice plate 608 communicate with each other is formed in the printhead 601.

As a comparative example of the temperature detection circuit according to the third embodiment, an example of the arrangement of a conventional temperature detection circuit will be explained.

Figure 9A:
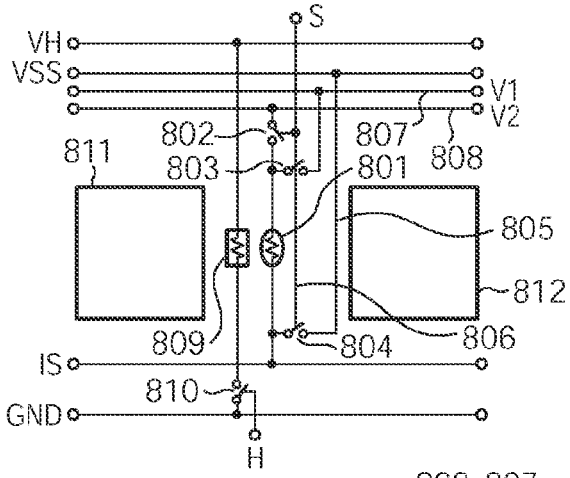
FIGS. 9A to 9C are views exemplifying a conventional arrangement.

FIG. 9A exemplifies the arrangement of a temperature detection circuit in which a printing element and temperature detection element are arranged. Independent supply ports 811 and 812 are also illustrated to clarify the arrangement relationship between the circuit and the independent supply ports.

A printing element 809 is arranged on a beam between the independent supply ports 811 and 812. One terminal of the printing element 809 is connected to a VH wiring line, and the other terminal is connected to a driving switch 810. The other terminal of the driving switch 810 is connected to a GND wiring line serving as the return destination of VH. The driving switch 810 is ON/OFF-controlled in accordance with a selection signal H from a printing element selection circuit (not shown).

One terminal of a temperature detection element 801 is commonly connected to the wiring line of the constant current IS for feeding power to the temperature detection element 801, and is also connected to a first readout switch 804 for reading out a terminal voltage. The other terminal of the temperature detection element 801 is connected to a selection switch 802, and a second readout switch 803 for reading out a terminal voltage.

The other terminal of the readout switch 804 is connected to a first common wiring line 807 via a wiring line 805 running between the independent supply ports 811 and 812. The other terminal of the readout switch 803 is connected to a second common wiring line 808.

The common wiring lines 807 and 808 are connected to a differential amplifier (not shown). Note that the common wiring lines 807 and 808 are parallelly laid out to be adjacent to each other so that even if common mode noise generated by electrostatic coupling or inductive coupling with another wiring line is superposed, the differential amplifier cancels the noise. A wiring line 806 of a selection signal S for ON/OFF-controlling the temperature detection element is connected to the selection switch 802 and the readout switches 803 and 804.

Figure 9B:
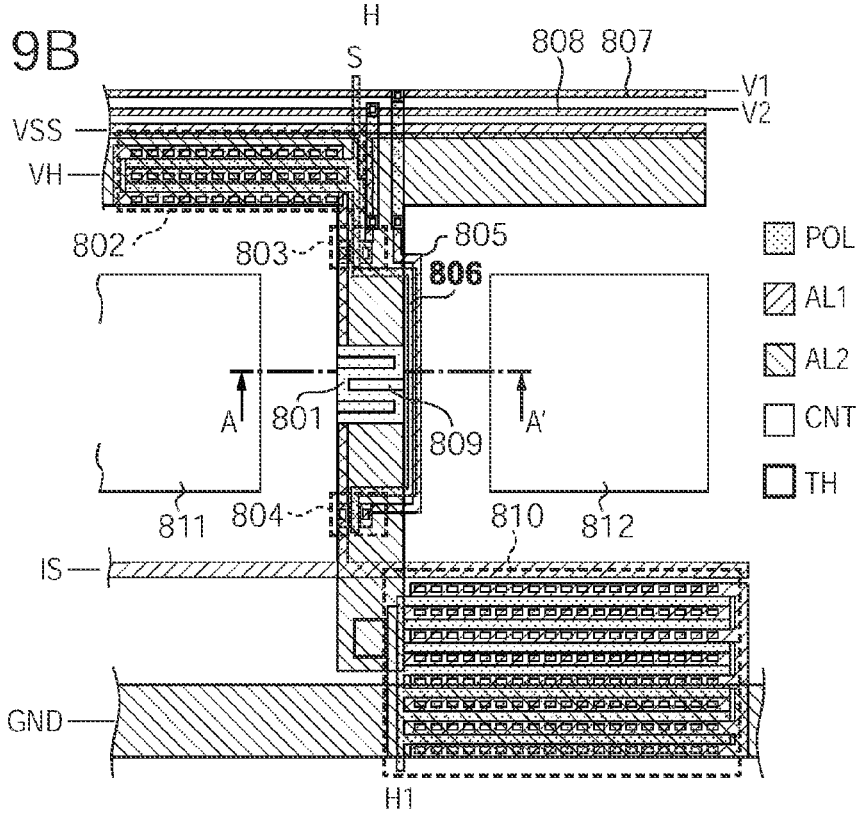

FIG. 9B is a view exemplifying the circuit arrangement of the printing element 809 and temperature detection element 801 arranged near the independent supply ports 811 and 812. A layout in which three interconnection layers, that is, a POL interconnection of polysilicon or the like, and AL1 and AL2 interconnections of aluminum or the like are arranged, and a switch is formed from a MOS transistor will be exemplified.

One terminal of the printing element 809 is connected to VH by the AL2 interconnection. The other terminal of the printing element 809 is connected to the AL1 interconnection of the drain electrode of the driving switch 810 via the AL2 interconnection and a through-hole TH. The AL1 interconnection of the source electrode of the driving switch 810 is connected to the GND wiring line of the AL2 interconnection via the through-hole TH. The POL interconnection of the gate electrode is connected to the selection signal H.

One terminal of the temperature detection element 801 is connected to the AL1 interconnection of the constant current IS and the AL1 interconnection serving as the source electrode of the first readout switch 804. The other terminal of the temperature detection element 801 is connected by the AL1 interconnection to the AL1 interconnection serving as the drain electrode of the selection switch 802 and the AL1 interconnection serving as the source electrode of the second readout switch 803.

The AL1 interconnection of the source electrode of the selection switch 802 is connected to VSS of the AL1 interconnection. The drain electrode of the first readout switch 804 runs through a beam between the independent supply ports, and is connected by the wiring line 805 to the POL interconnection via a contact CNT. The drain electrode of the first readout switch 804 is also connected to the first common wiring line V1 of the AL1 interconnection via the contact CNT.

The drain electrode of the second readout switch 803 is connected from the AL1 interconnection to the POL interconnection via the contact CNT. The drain electrode of the second readout switch 803 is also connected to the second common wiring line V2 of the AL1 interconnection via the contact CNT. The POL interconnection of the gate electrodes of the readout switches 803 and 804 is laid out to run through the beam between the independent supply ports. This wiring line is connected to the gate electrode of the selection switch 802, and the selection signal S for selecting a temperature detection element is transferred.

Figure 9C:
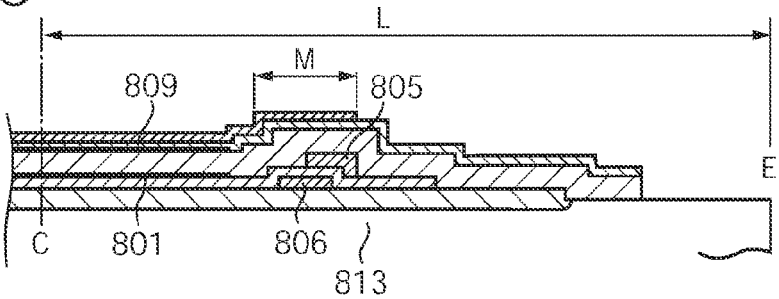

FIG. 9C is a sectional view exemplifying a sectional arrangement taken along a line A-A' shown in FIG. 9B. More specifically, FIG. 9C is a sectional view showing the section of the printing element substrate from the supply port edge E to the center C of the printing element 809.

An oxide film is arranged on a silicon substrate 813. The polysilicon wiring line 806 of the first interconnection layer POL, an insulating layer, the aluminum wiring line 805 of the second interconnection layer AL1, and the temperature detection element 801 are formed on the oxide film. Further, an insulating layer, the printing element 809, an insulating layer, and an anti-cavitation layer are formed on this structure. Although not shown, a channel is formed from a nozzle member on the anti-cavitation layer. A wiring region M is formed between the printing element 809 and the independent supply port edge E. In the wiring region M, the AL1 wiring line 805 and POL wiring line 806 are laid out to run between the independent supply ports 811 and 812.

In the conventional arrangement, the AL1 wiring line 805 and POL wiring line 806 need to run between the independent supply ports 811 and 812. For this reason, the wiring region M is necessary, increasing the channel length L from the independent supply port edge E to the center C of the printing element 809.

A large channel length reduces the effect of increasing the discharge frequency, which is described in Japanese Patent Laid-Open No. 2010-201921. In addition, the interval between nozzles also increases, restricting an increase in resolution. To maintain the resolution, the supply port width in the nozzle array direction needs to be decreased. To uniform the flow resistance, the number of supply ports in the direction of length needs to be increased, resulting in a large printing element substrate.

An arrangement for solving the problem of the conventional arrangement will be described. That is, an arrangement according to the third embodiment will be explained. An example of the connection diagram of a printing element substrate 701 will be explained with reference to FIG. 10. An arrangement in which printing elements and temperature detection elements for four segments are arranged will be exemplified. Note that independent supply ports 718 and 719 are also illustrated to clarify the arrangement relationship between the circuit and the independent supply ports.

A printing element 715 of Seg1 is arranged on a beam between the independent supply ports 718 and 719. One terminal of the printing element 715 of Seg1 is connected to a VH wiring line for supplying a voltage to the printing element 715, and the other terminal is connected to a driving switch 716. The other terminal of the driving switch 716 is connected to a GND wiring line serving as the return destination of VH.

The driving switch 716 is ON/OFF-controlled in accordance with a selection signal H1 from a printing element selection circuit 717. Seg2 to Seg4 also have the same connection as that of Seg1. The printing element selection circuit 717 has the same function as that of the driving element selection circuit 117 described in the first embodiment, and a detailed description thereof will not be repeated.

One terminal of a temperature detection element 702 of Seg1 is commonly connected to the wiring line of the constant current IS to be supplied to the temperature detection element 702. The other terminal of the temperature detection element 702 of Seg1 is connected to a selection switch 703 and a second readout switch 704 for reading out a terminal voltage. The other terminal of the second readout switch 704 is connected to a second common wiring line 712. The other terminal of the selection switch 703 is connected to a VSS wiring line serving as the return destination of the constant current IS. A terminal of the temperature detection element 702 that is connected to the wiring line of the constant current IS is connected to a first readout switch 705 via the wiring line of the constant current IS and a temperature detection element 706 of Seg2. The other terminal of the first readout switch 705 is connected to a first common wiring line 711. The temperature detection elements of Seg2 to Seg4 are also connected similarly to that of Seg1.

In this manner, a terminal of the temperature detection element that is commonly connected to the wiring line of the constant current IS is connected to the first readout switch via an adjacent temperature detection element. Note that Seg4 is arranged at the end of the circuit, and the wiring line of the constant current IS is directly connected to a readout switch 710. One terminal of the temperature detection element of Seg4 is connected to the common wiring line 711.

The common wiring lines 711 and 712 are connected to a differential amplifier 713. The selection switches and readout switches of Seg1 to Seg4 are ON/OFF-controlled in accordance with selection signals S1 to S4 output from a temperature detection element selection circuit 714. The temperature detection element selection circuit 714 has the same function as that of the detection element selection circuit 114 described in the first embodiment, and a detailed description thereof will not be repeated.

Figure 10:
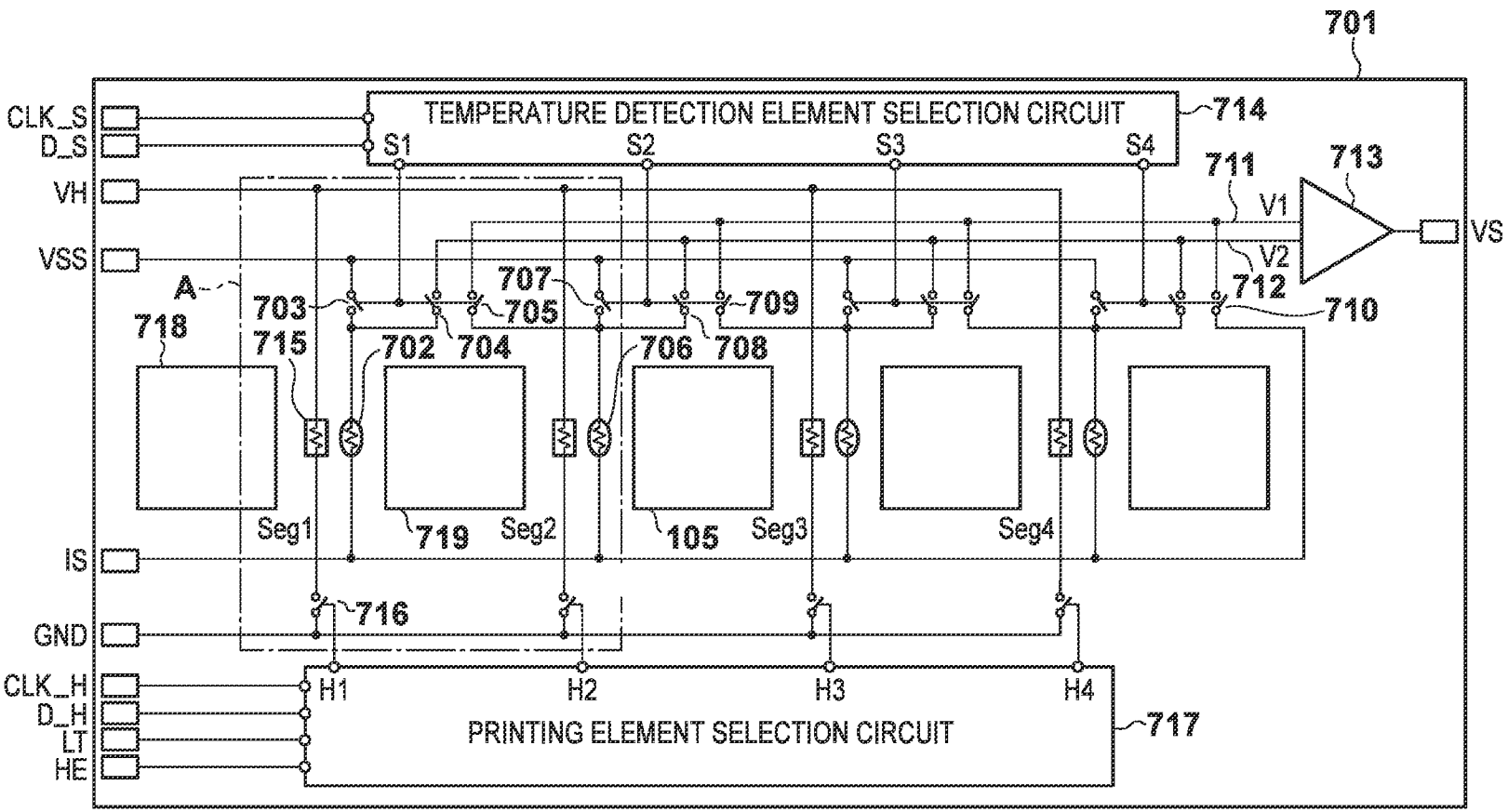
FIG. 10 is a connection diagram showing a printing element substrate according to the third embodiment.
Figure 11A:
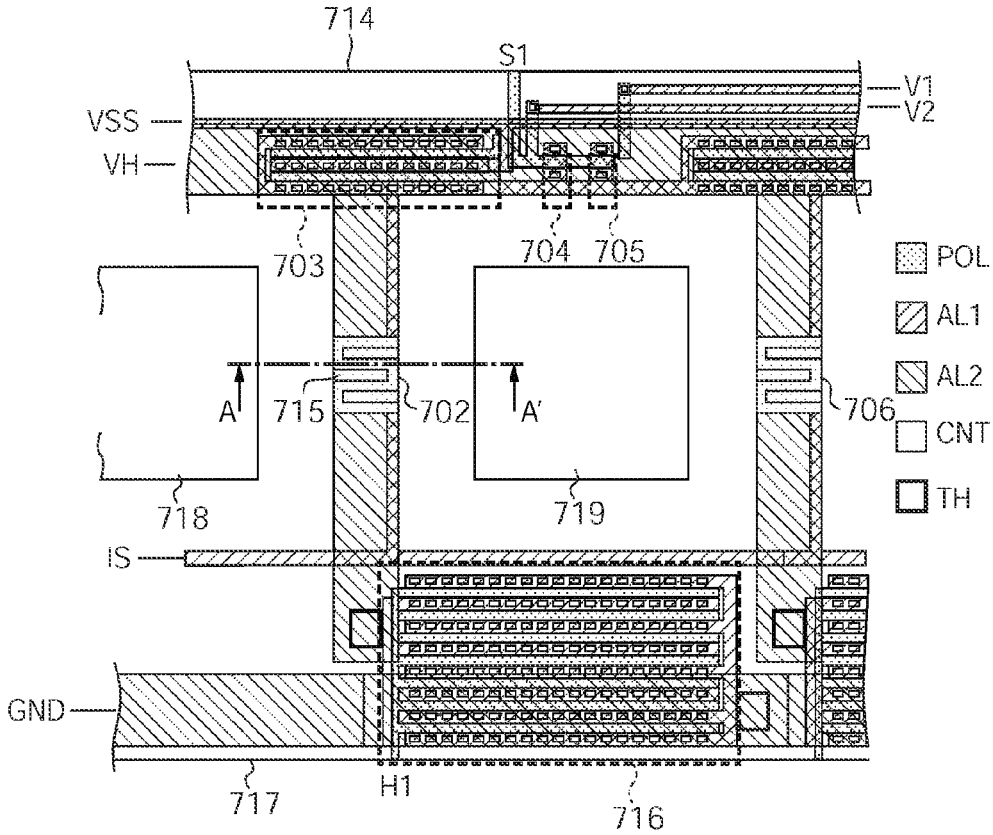
FIGS. 11A and 11B are views exemplifying the arrangement of the printing element substrate according to the third embodiment.

FIG. 11A is a view exemplifying the layout of a circuit in area A of FIG. 10. More specifically, FIG. 11A exemplifies the layout of the circuit arrangement of the printing element 715 and temperature detection element 702 arranged near the independent supply port 719. A layout in which three interconnection layers, that is, a POL interconnection of polysilicon or the like, and AL1 and AL2 interconnections of aluminum or the like are arranged, and a switch is formed from a MOS transistor will be exemplified.

One terminal of the printing element 715 is connected to the VH wiring line by the AL2 interconnection. The other terminal of the printing element 715 is connected to the AL1 interconnection of the drain electrode of the driving switch 716 via the AL2 interconnection and a through-hole TH. The AL1 interconnection of the source electrode of the driving switch 716 is connected to the GND wiring line of the AL2 interconnection via the through-hole TH. The POL interconnection of the gate electrode is connected to the selection signal H1 from the printing element selection circuit 717.

One terminal of the temperature detection element 702 is commonly connected by the AL1 interconnection of the constant current IS. The other terminal of the temperature detection element 702 is connected by the AL1 interconnection to the AL1 interconnection of the drain electrode of the selection switch 703 and the AL1 interconnection serving as the source electrode of the second readout switch 704. The AL1 interconnection of the source electrode of the selection switch 703 is connected to the VSS wiring line of the AL1 interconnection. The drain electrode of the second readout switch 704 is connected from the AL1 interconnection to the POL interconnection via the contact CNT. The drain electrode of the second readout switch 704 is also connected to the second common wiring line V2 of the AL1 interconnection via the contact CNT.

Of terminals of the temperature detection element 702, a terminal connected to the AL1 interconnection of the constant current IS is connected to the source electrode of the first readout switch 705 by the AL1 interconnection via the AL1 interconnection of the constant current IS and the temperature detection element 706 of Seg2. The drain electrode of the readout switch 705 is connected from the AL1 interconnection to the POL interconnection via the contact CNT. The drain electrode of the readout switch 705 is also connected to the first common wiring line V1 of the AL1 interconnection via the contact CNT.

Figure 11B:
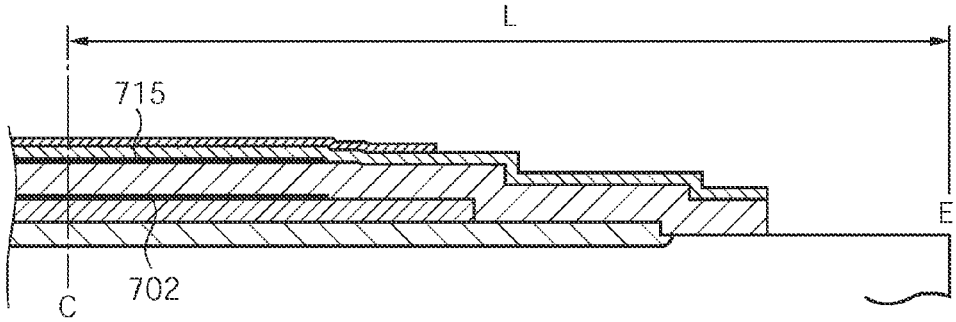

FIG. 11B is a sectional view exemplifying a sectional arrangement taken along a line A-A' shown in FIG. 11A. FIG. 11B is a sectional view showing the section of the printing element substrate 701 from the independent supply port edge E to the center C of the printing element 715.

In the arrangement shown in FIG. 11B, only the printing element 715 and temperature detection element 702 are laid out, and the wiring region M pertaining to the temperature detection circuit is omitted, unlike the conventional arrangement shown in FIG. 9C. As a result, the channel length L need not be increased.

An operation in the printing element substrate 701 according to the third embodiment described with reference to FIGS. 10, 11A, and 11B will be described. Seg1 will be exemplified here.

First, the temperature detection element selection circuit 714 enables the selection signal S1 to turn on the selection switch 703 and the readout switches 704 and 705, thereby selecting the temperature detection element 702 of Seg1.

Upon turning on the selection switch 703, the constant current IS is supplied to the temperature detection element 702, and the temperature detection element 702 outputs a terminal voltage corresponding to a temperature. The terminal voltage V2 signal of the temperature detection element 702 on the side of the selection switch 703 is input to the differential amplifier 713 via the readout switch 704. The terminal voltage V1 signal of the temperature detection element 702 on the wiring line side of the constant current IS is input to the differential amplifier 713 via the temperature detection element 706 of Seg2 and the readout switch 705.

Upon receiving the V1 and V2 signals, the differential amplifier 713 outputs a differential signal VS serving as a voltage across the temperature detection element 702. In the same manner, Seg2 to Seg4 are sequentially selected, reading out detection information (temperature data) of the respective segments. Note that the printing element selection circuit 717 and temperature detection element selection circuit 714 have the same arrangements and operations as those of the driving element selection circuit 117 and detection element selection circuit 114 described in the first embodiment, and a description thereof will not be repeated.

As described above, according to the third embodiment, a terminal of the temperature detection element that is commonly connected to the wiring line of the constant current IS is connected to the first common wiring line using an adjacent temperature detection element as a wiring line. This arrangement can omit a wiring line running between independent supply ports. As a result, the temperature detection circuit can be arranged without influencing the channel length and the channel region of the independent supply port.

Fourth Embodiment

The fourth embodiment will be described. In the first to third embodiments, a temperature detection element is connected via an adjacent temperature detection element. However, the present invention is not limited to this. For example, a temperature detection element can be connected via a temperature detection element spaced apart by two or more segments. In other words, a temperature detection element can be connected via any detection element except for a detection element selected by the selection switch. An example of a connection arrangement via a second adjacent temperature detection element will be explained. Note that the arrangement of the control system of a printing apparatus 10 is the same as that in FIG. 4 described in the second embodiment, and a description thereof will not be repeated.

Figure 12:
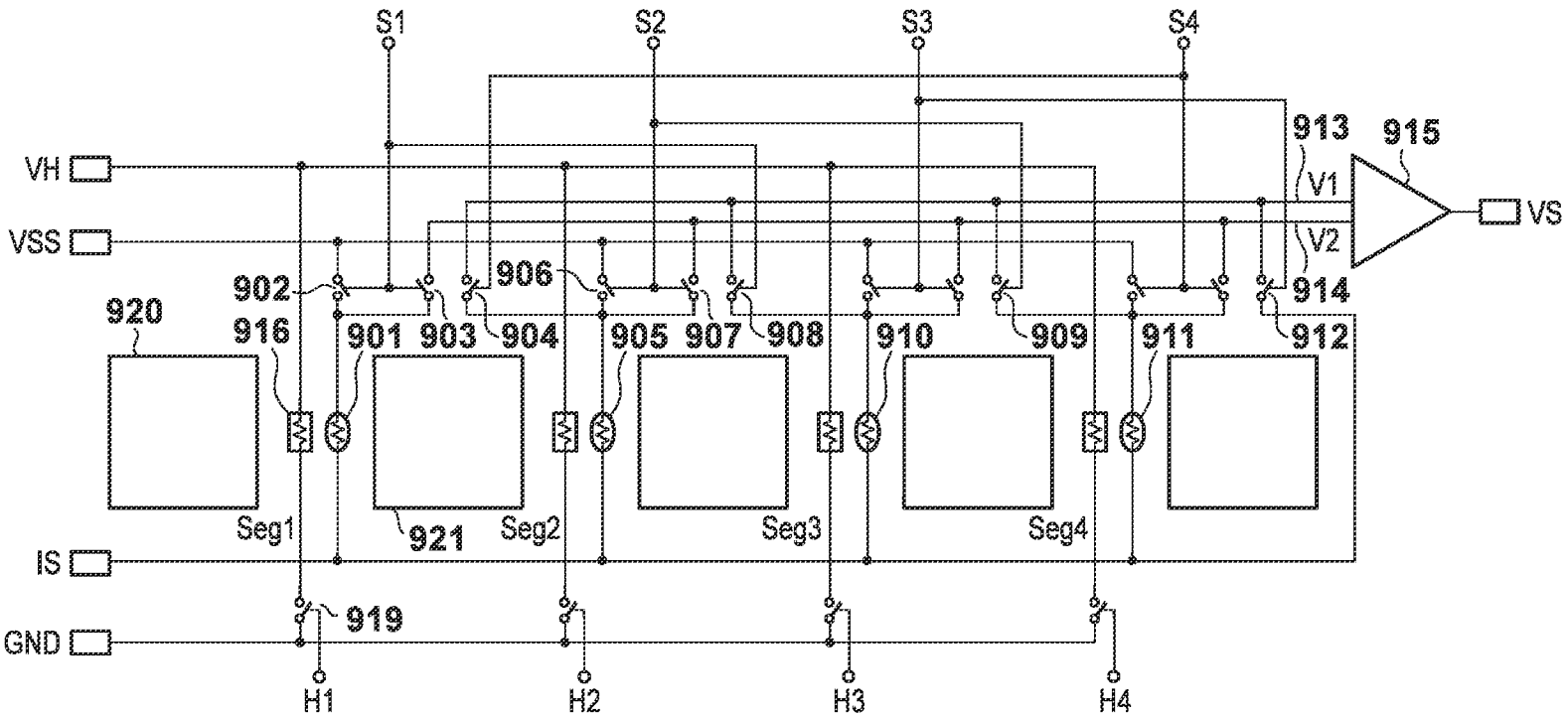
FIG. 12 is a connection diagram showing a printing element substrate according to the fourth embodiment.

FIG. 12 exemplifies the connection diagram of a printing element substrate according to the fourth embodiment. Independent supply ports 920 and 921 are also illustrated to clarify the arrangement relationship between the circuit and the independent supply ports.

One terminal of a temperature detection element 901 of Seg1 is commonly connected to the wiring line of the constant current IS for feeding power to the temperature detection element. The other terminal of the temperature detection element 901 of Seg1 is connected to a selection switch 902 and a second readout switch 903 for reading out a terminal voltage. The other terminal of the readout switch 903 is connected to a second common wiring line 914. The other terminal of the selection switch 902 is connected to a VSS wiring line serving as the return destination of the constant current IS.

The commonly connected terminal of the temperature detection element 901 is connected to a first readout switch 908 via the wiring line of the constant current IS and a temperature detection element 910 of Seg3. The other terminal of the first readout switch 908 is connected to a first common wiring line 913.

The common wiring lines 913 and 914 are connected to a differential amplifier 915. A selection signal S1 output from a temperature detection element selection circuit (not shown) is supplied to the selection switch 902, the second readout switch 903, and the first readout switch 908.

Similar to Seg1, a temperature detection element 905 of Seg2 is also connected to a first readout switch 909 via a second adjacent temperature detection element 911 of Seg4. In the temperature detection element 910 of Seg3, the wiring line of the constant current IS is directly connected to a first readout switch 912. One terminal of the temperature detection element 910 of Seg3 is connected to the first common wiring line 913. The temperature detection element 911 of Seg4 is connected to a first readout switch 904 via the temperature detection element 905 of Seg2. One terminal of the temperature detection element 911 of Seg4 is connected to the first common wiring line 913.

An operation in the above-described printing element substrate will be described. Seg1 will be exemplified here.

First, the temperature detection element selection circuit (not shown) enables the selection signal S1 to turn on the selection switch 902 and the readout switches 903 and 908, thereby selecting the temperature detection element 901 of Seg1.

Upon turning on the selection switch 902, the constant current IS is supplied to the temperature detection element 901, and the temperature detection element 901 outputs a terminal voltage corresponding to a temperature. The terminal voltage V2 signal of the temperature detection element 901 on the side of the selection switch 902 is input to the differential amplifier 915 via the second readout switch 903. The terminal voltage V1 signal of the temperature detection element 901 on the wiring line side of the constant current IS is input to the differential amplifier 915 via the temperature detection element 910 of Seg3 and the first readout switch 908.

Upon receiving the V1 and V2 signals, the differential amplifier 915 outputs a differential signal VS serving as a voltage across the temperature detection element 901. In the same fashion, Seg2 to Seg4 are also sequentially selected, reading out detection information (temperature data) of the respective segments.

As described above, according to the fourth embodiment, temperature data of a temperature detection element selected via a distant temperature detection element can be read out by changing the connections of the selection signals S1 to S4 to the readout switches. The same effects as those of the first to third embodiments can be obtained even when a temperature detection element is connected to the first common wiring line via a temperature detection element spaced apart by two or more segments.

Fifth Embodiment

The fifth embodiment will be described. In the first to fourth embodiments, a temperature detection element is connected via one temperature detection element. However, the present invention is not limited to this. For example, an arrangement shown in FIG. 13 will be explained. Note that the arrangement of the control system of a printing apparatus 10 is the same as that in FIG. 4 described in the second embodiment, and a description thereof will not be repeated.

Figure 13:
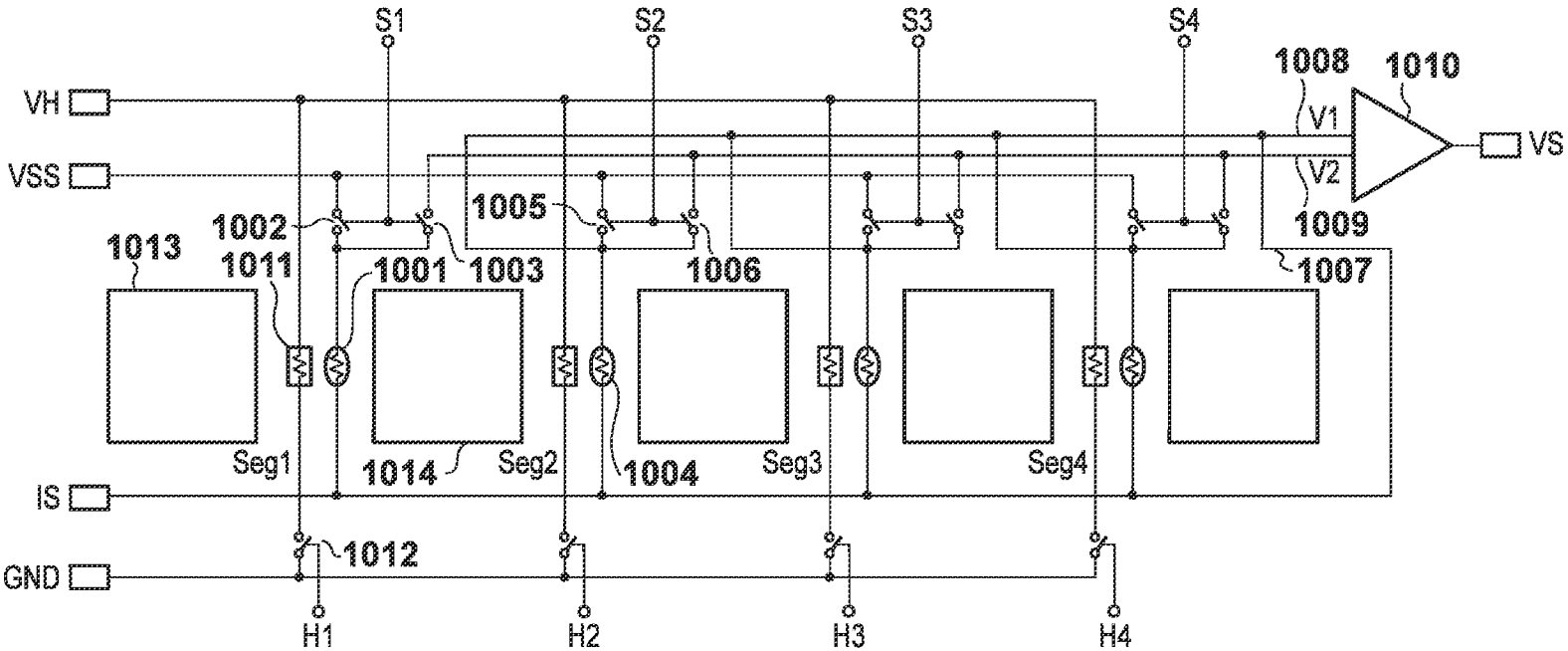
FIG. 13 is a connection diagram showing a printing element substrate according to the fifth embodiment.

FIG. 13 exemplifies the connection diagram of a printing element substrate according to the fifth embodiment. Independent supply ports 1013 and 1014 are also illustrated to clarify the arrangement relationship between the circuit and the independent supply ports.

One terminal (first terminal) of a temperature detection element 1001 of Seg1 is commonly connected to the wiring line of the constant current IS for supplying a current to the temperature detection element 1001. The other terminal (second terminal) of the temperature detection element 1001 of Seg1 is connected to a selection switch 1002 and a readout switch 1003 for reading out a terminal voltage. The other terminal of the readout switch 1003 is connected to a second common wiring line 1009. The other terminal of the selection switch 1002 is connected to a VSS wiring line serving as the return destination of the constant current IS.

A terminal of the temperature detection element 1001 that is commonly connected to the wiring line of the constant current IS is connected to a first common wiring line 1008 via the wiring line of the constant current IS and a wiring line 1007 (that is, all other temperature detection elements). The common wiring lines 1008 and 1009 are connected to a differential amplifier 1010.

A temperature detection element selection circuit (not shown) outputs a selection signal S1 to turn on the selection switch 1002 and readout switch 1003. The temperature detection elements of Seg2 to Seg4 are also connected similarly to Seg1.

An operation in the above-described printing element substrate will be described. Seg1 will be exemplified here.

First, the temperature detection element selection circuit (not shown) enables the selection signal S1 to turn on the selection switch 1002 and readout switch 1003, thereby selecting the temperature detection element 1001 of Seg1.

Upon turning on the selection switch 1002, the constant current IS is supplied to the temperature detection element 1001, and the temperature detection element 1001 outputs a terminal voltage corresponding to a temperature. The terminal voltage V2 signal of the temperature detection element 1001 on the side of the selection switch 1002 is input to the differential amplifier 1010 via the readout switch 1003. The terminal voltage V1 signal of the temperature detection element 1001 on the wiring line side of the constant current IS is input to the differential amplifier 1010 via the temperature detection elements of Seg2 to Seg4. Upon receiving the V1 and V2 signals, the differential amplifier 1010 outputs a differential signal VS serving as a voltage across the temperature detection element 1001. Seg2 to Seg4 are also sequentially selected, reading out detection information (temperature data) of the respective segments.

As described above, according to the fifth embodiment, one terminal of each temperature detection element is directly connected to the first common wiring line 1008. This omits one individual wiring line out of readout wiring lines for two terminals of the temperature detection element.

Sixth Embodiment

The sixth embodiment will be described. The sixth embodiment will explain a connection arrangement in which a plurality of temperature detection elements are series-connected. Note that the arrangement of the control system of a printing apparatus 10 is the same as that in FIG. 4 described in the second embodiment, and a description thereof will not be repeated.

Figure 14:
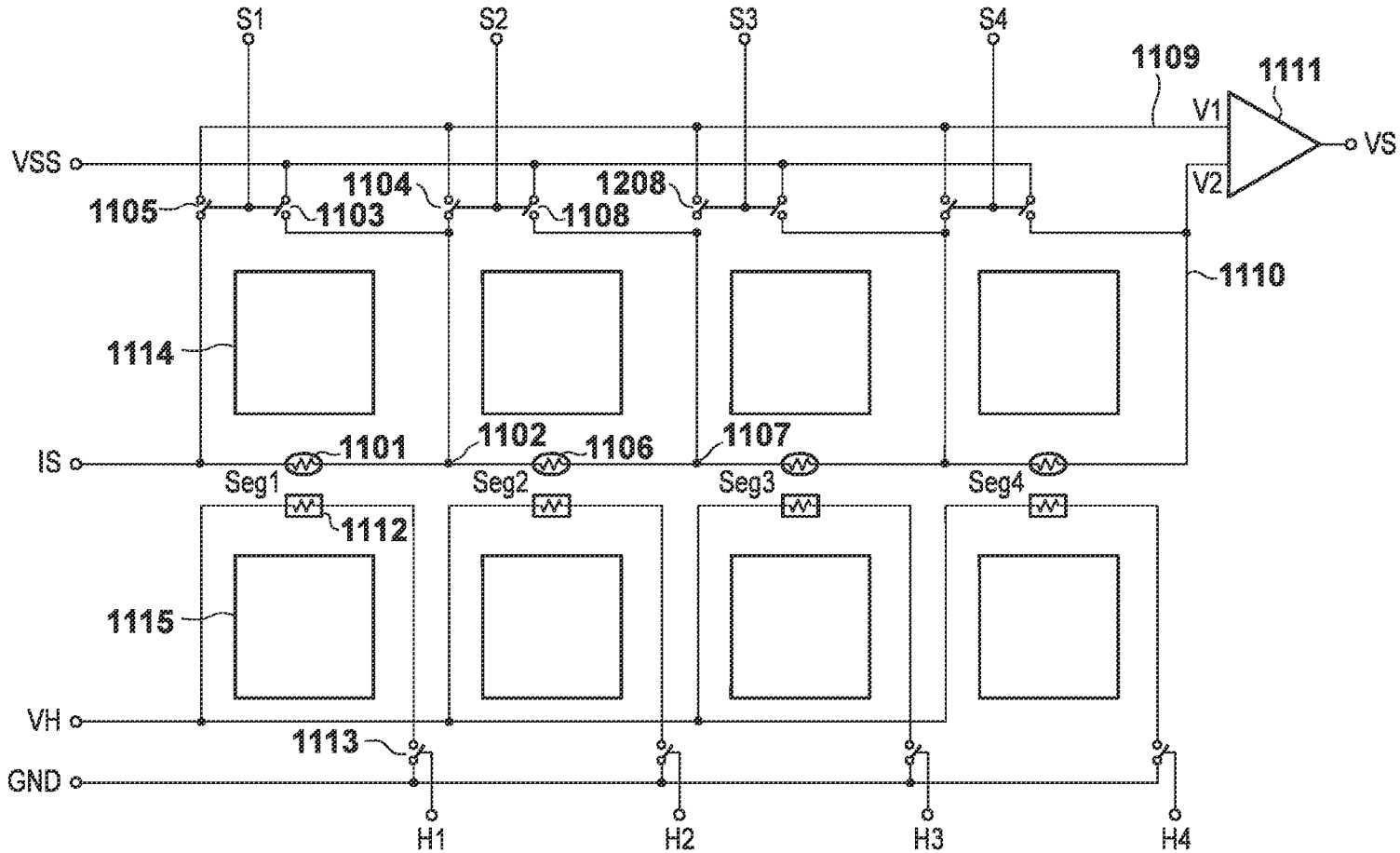
FIG. 14 is a connection diagram showing a printing element substrate according to the sixth embodiment.

FIG. 14 exemplifies the connection diagram of a printing element substrate in which a printing element and temperature detection element are arranged on a beam sandwiched between independent supply ports of two arrays. Independent supply ports 1114 and 1115 are also illustrated to clarify the arrangement relationship between the circuit and the independent supply ports.

A printing element 1112 of Seg1 is arranged on a beam between the independent supply ports 1114 and 1115. One terminal of the printing element 1112 of Seg1 is connected to a VH wiring line for supplying a voltage to the printing element 1112. The other terminal of the printing element 1112 of Seg1 is connected to a driving switch 1113. The other terminal of the driving switch 1113 is connected to a GND wiring line serving as the return destination of VH. The driving switch 1113 is ON/OFF-controlled in accordance with a selection signal H1 from a printing element selection circuit (not shown). Seg2 to Seg4 also have the same connection as that of Seg1.

One terminal (first terminal) of a temperature detection element 1101 of Seg1 is connected to a (upstream) wiring line of the constant current IS to be supplied to the temperature detection element 1101, and a readout switch 1105. The other terminal (second terminal) of the temperature detection element 1101 of Seg1 is connected to a (downstream) wiring line of the constant current IS, and connected to a selection switch 1103 of Seg1, a temperature detection element 1106 of Seg2, and a readout switch 1104 of Seg2. The other terminal of the selection switch 1103 is connected to a VSS wiring line serving as the return destination of the constant current IS. The other terminal of each of the readout switches 1105 and 1104 is connected to a first common wiring line 1109.

The temperature detection elements of Seg1 to Seg4 are series-connected. One terminal of the temperature detection element of Seg4 serving as a terminator and the first common wiring line 1109 is connected to a differential amplifier 1111. A branch point 1102 is set between Seg1 and Seg2. Similarly, branch points are set between Seg2 and Seg3, and Seg3 and Seg4. The readout switch 1104 is arranged on a path extending from each branch point to the VSS wiring line.

An operation in the above-described printing element substrate will be described. Seg1 will be exemplified here.

First, a temperature detection element selection circuit (not shown) enables a selection signal S1 to turn on the selection switch 1103 and readout switch 1105, thereby selecting the temperature detection element 1101 of Seg1.

Upon turning on the selection switch 1103, the constant current IS is supplied to the temperature detection element 1101, and the temperature detection element 1101 outputs a terminal voltage corresponding to a temperature. The terminal voltage V1 signal of the temperature detection element 1101 on the side of the readout switch 1105 is input to the differential amplifier 1111 via the readout switch 1105. The terminal voltage V2 signal of the temperature detection element 1101 on the side of the branch point 1102 is input to the differential amplifier 1111 via the series-connected temperature detection elements of Seg2 to Seg4 and a wiring line 1110.

Upon receiving the V1 and V2 signals, the differential amplifier 1111 outputs a differential signal VS serving as a voltage across the temperature detection element 1101. Seg2 to Seg4 are also sequentially selected, reading out detection information (temperature data) of the respective segments.

As described above, according to the sixth embodiment, a terminal voltage at each branch of the series connection of a temperature detection element array, and a terminal voltage at the terminator (most downstream side) of the temperature detection element array are read out. Temperature data of a selected temperature detection element can be read out via other temperature detection elements.

Seventh Embodiment

The seventh embodiment will be described. The third to sixth embodiments have explained a case in which printing elements are arrayed on beams in the column direction parallel to the independent supply port array direction, and circuits are arranged parallel to the printing elements.

To the contrary, the seventh embodiment will describe a case in which printing elements are arrayed on a beam in the row direction perpendicular to the independent supply port array direction, and circuits are also arranged to have a perpendicular positional relationship. Note that the arrangement of the control system of a printing apparatus 10 is the same as that in FIG. 4 described in the second embodiment, and a description thereof will not be repeated.

Figure 15B:
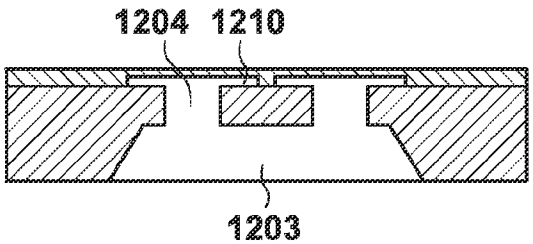
FIGS. 15A to 15C are views exemplifying the arrangement of a printhead according to the seventh embodiment.
Figure 15C:
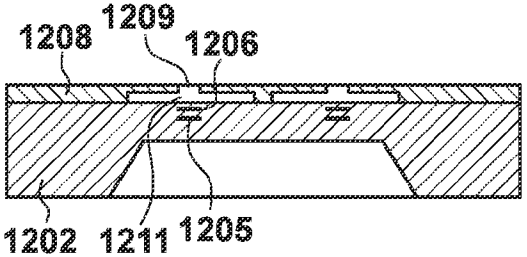
Figure 15A:
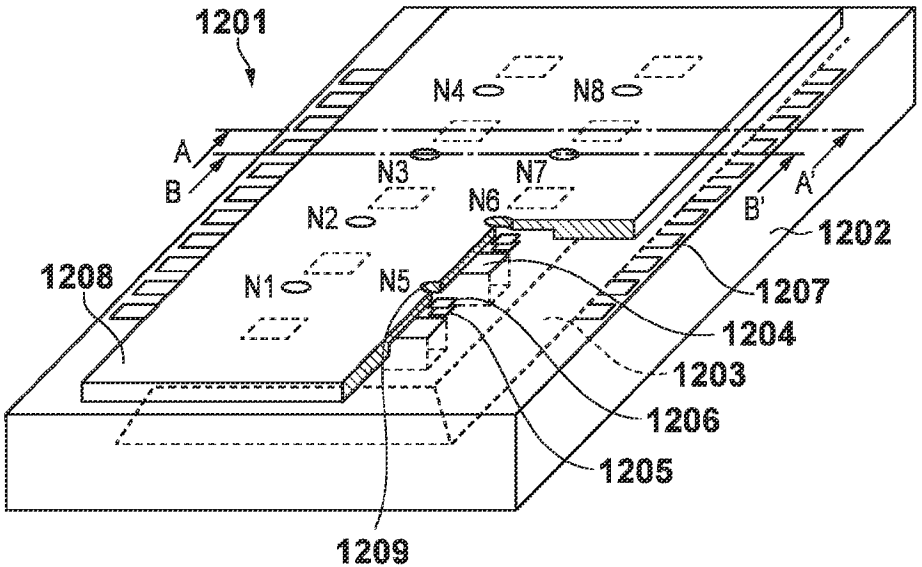

An example of the arrangement of a printhead according to the seventh embodiment will be explained with reference to FIGS. 15A to 15C. FIG. 15A is a perspective view showing the printhead according to the seventh embodiment. FIG. 15B is a sectional view exemplifying a sectional arrangement taken along a line A-A' shown in FIG. 15A. FIG. 15C is a sectional view exemplifying a sectional arrangement taken along a line B-B' shown in FIG. 15A.

A common supply port 1203 is formed in a printhead 1201. A plurality of independent supply ports 1204 are formed in a printing element substrate 1202 to communicate with the common supply port 1203.

Pairs each of a printing element 1206 and temperature detection element 1205 are formed in the printing element substrate 1202. The pair of printing element 1206 and temperature detection element 1205 is arranged on a beam between independent supply ports. Pressure chambers 1211 communicating with the independent supply ports 1204, and nozzles 1209 are formed in an orifice plate 1208 in correspondence with the printing elements. In the orifice plate 1208, 2×4 nozzles N1 to N4 and N5 to N8 are arrayed. Electrode terminals 1207 are connected to external wiring lines.

As shown in FIG. 15B, an ink supply path in which the common supply port 1203, the independent supply ports 1204, and liquid chambers 1210 of the orifice plate 1208 communicate with each other is formed in the printing element substrate 1202.

Figure 16:
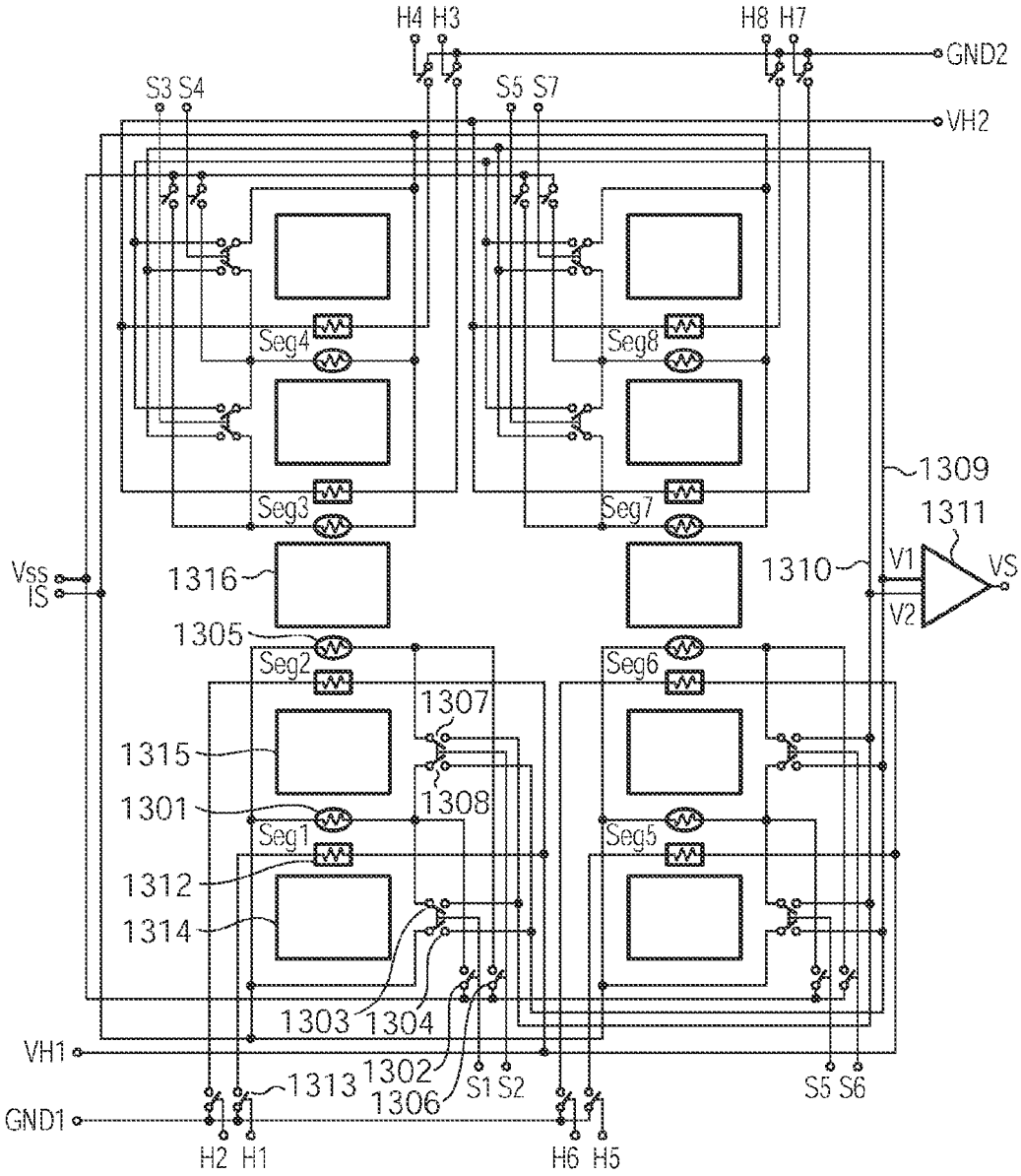
FIG. 16 is a connection diagram showing a printing element substrate according to the seventh embodiment.

An example of the connection diagram of the printing element substrate 1202 shown in FIGS. 15A to 15C will be explained with reference to FIG. 16. An arrangement in which printing elements and temperature detection elements for eight segments are arranged will be exemplified. Note that independent supply ports 1314 and 1315 are also illustrated to clarify the arrangement relationship between the circuit and the independent supply ports.

A printing element 1312 of Seg1 is arranged on a beam between the independent supply ports 1314 and 1315. One terminal of the printing element 1312 of Seg1 is connected to a VH wiring line for supplying a driving voltage to the printing element 1312. The other terminal of the printing element 1312 of Seg1 is connected to a driving switch 1313. The other terminal of the driving switch 1313 is connected to a GND1 wiring line serving as the return destination of VH.

The driving switch 1313 is ON/OFF-controlled in accordance with a selection signal H1 output from a printing element selection circuit (not shown). Seg2, Seg5, and Seg6 also have the same connection as that of Seg1. Seg3, Seg4, Seg7, and Seg8 are arranged to face Seg1, Seg2, Seg5, and Seg6 via independent supply ports at the center. These segments also have the same connection as that of Seg1, Seg2, Seg5, and Seg6. Note that the printing element selection circuit (not shown) has the same function as that of the driving element selection circuit 117 described in the first embodiment, and is arranged individually on each of the side of Seg1, Seg2, Seg5, and Seg6 and the side of Seg3, Seg4, Seg7, and Seg8.

One terminal of a temperature detection element 1305 of Seg2 is commonly connected to the wiring line of the constant current IS to be supplied to the temperature detection element 1305. The other terminal of the temperature detection element 1305 of Seg2 is connected to a selection switch 1306 and second readout switch 1307. The other terminal of the readout switch 1307 is connected to a second common wiring line 1310.

One terminal of a first readout switch 1308 is connected to the wiring line of the constant current IS via a temperature detection element 1301 of Seg1. The other terminal of the first readout switch 1308 is connected to a first common wiring line 1309.

One terminal of the temperature detection element 1301 of Seg1 is connected to the wiring line of the constant current IS for supplying a current to the temperature detection element, and connected to a readout switch 1304. Therefore, one terminal of the temperature detection element 1301 of Seg1 is connected to the first common wiring line 1309 via the readout switch 1304. The other terminal of the temperature detection element 1301 of Seg1 is connected to a selection switch 1302 and readout switch 1303. The other terminal of the selection switch 1303 is connected to the second common wiring line 1310. The common wiring lines 1309 and 1310 are connected to a differential amplifier 1311.

A selection signal S2 output from a temperature detection element selection circuit (not shown) is supplied to the selection switch 1306 and the readout switches 1307 and 1308. Seg5 and Seg6 on the second row also have the same connection. Seg3, Seg4, Seg7, and Seg8 arranged at opposite positions also have the same connection as that of Seg1, Seg2, Seg5, and Seg6.

Note that the temperature detection element selection circuit (not shown) has the same function as that of the detection element selection circuit 114 described in the first embodiment, and is arranged individually on each of the side of Seg1, Seg2, Seg5, and Seg6 and the side of Seg3, Seg4, Seg7, and Seg8.

An operation in the above-described printing element substrate will be explained. Seg2 will be exemplified here.

First, the temperature detection element selection circuit (not shown) enables the selection signal S2 to turn on the selection switch 1306 and the readout switches 1307 and 1308, thereby selecting the temperature detection element 1305 of Seg2.

Upon turning on the selection switch 1306, the constant current IS is supplied to the temperature detection element 1305, and the temperature detection element 1305 outputs a terminal voltage corresponding to a temperature. The terminal voltage V2 signal of the temperature detection element 1305 on the side of the selection switch 1306 is input to the differential amplifier 1311 via the readout switch 1307. The terminal voltage V1 signal of the temperature detection element 1305 on the wiring line side of the constant current IS is input to the differential amplifier 1311 via the temperature detection element 1301 of Seg1 and the readout switch 1308.

Upon receiving the V1 and V2 signals, the differential amplifier 1311 outputs a differential signal VS serving as a voltage across the temperature detection element 1305. In the same manner, the remaining segments are also sequentially selected, reading out detection information (temperature data) of the respective segments.

As described above, according to the seventh embodiment, printing elements are arrayed on beams in the row direction perpendicular to the independent supply port array direction, and circuits are arranged to have a perpendicular positional relationship. Even in this case, temperature data of a selected temperature detection element can be read out via other temperature detection elements.

Typical embodiments of the present invention have been exemplified. However, the present invention is not limited to the above-described, illustrated embodiments, and can be properly modified without departing from the gist of the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-227435, filed Oct. 14, 2011, which is hereby incorporated by reference herein in its entirety.

What is claimed is:

1. An element substrate comprising:

a first driving element and a second driving element for generating energy;

a first resistance element corresponding to said first driving element and a second resistance element corresponding to said second driving element, each of the first and second resistance elements including a first terminal and a second terminal, wherein the first terminals of said first resistance element and said second resistance element are connectable through switches to a first line for supplying a first current, and the second terminals of said first resistance element and second resistance element are commonly connected to a second line for supplying a second current;

a selection unit connected to the switches and configured to selectively supply power to the first and second resistance elements; and a detection unit configured to detect a voltage of the first terminal of said first resistance element and a voltage of the first terminal of said second resistance element while the power is supplied to said first resistance element and is not supplied to said second resistance element, wherein said first driving element, said first resistance element, said second driving element and said second resistance element are arranged in one line.

2. The substrate according to claim 1, wherein a current path length for supplying the first or second current to said second resistance element is longer than a current path length for supplying the first or second current to said first resistance element.

3. The substrate according to claim 1, wherein the sum of the length of the first line and the length of the second line for supplying the first and second currents to said second resistance element is longer than the sum of the length of the first line and the length of the second line for supplying the first and second currents to said first resistance element.

4. The substrate according to claim 1, wherein when the selection unit effects supplying of the power to said first resistance element and said second resistance element, a constant current as the first current is supplied to said first resistance element and said second resistance element.

5. The substrate according to claim 1, wherein the selection unit is configured to select one of said first resistance element and said second resistance element as a resistance element which supplies a constant current as the first current.

6. The substrate according to claim 1, wherein the switches are arranged in correspondence with said first resistance element and said second resistance element, for switching between a state in which the power is supplied and a state in which no power is supplied.

7. The substrate according to claim 1, wherein said detection unit includes an input unit configured to input a voltage, and said input unit has a high input resistance to prevent one of the first and second currents from flowing into said input unit.

8. A printhead comprising:

a nozzle plate having nozzles through which ink is discharged; and the element substrate according to claim 1 connected to the nozzle plate and generating the energy to discharge the ink.

9. A printing apparatus comprising:

a current generation unit configured to generate the first or second current; and a printhead control unit configured to control an operation of the element substrate according to claim 1.

* * * * *